US012779627B2

(12) United States Patent
Nguyen

(10) Patent No.: US 12,779,627 B2
(45) **Date of Patent: *Nov. 3, 2026**

(54) METHODS AND SYSTEMS FOR ABRASIVE BLASTING

(71) Applicant: Axxiom Manufacturing, Inc., Fresno, TX (US)

(72) Inventor: Phuong Taylor Nguyen, Richmond, TX (US)

(73) Assignee: Axxiom Manufacturing, Inc., Fresno, TX (US)

( * ) Notice: Subject to any disclaimer, the term of this patent is extended or adjusted under 35 U.S.C. 154(b) by 948 days.

This patent is subject to a terminal disclaimer.

(21) Appl. No.: 17/731,029

(22) Filed: Apr. 27, 2022

(65) Prior Publication Data

US 2023/0347472 A1 Nov. 2, 2023

(51) Int. Cl.
*B24C 7/00* (2006.01)
*B24C 5/02* (2006.01)

(52) U.S. Cl.
CPC ..... *B24C 7/0053* (2013.01); *B24C 5/02* (2013.01)

(58) Field of Classification Search
None
See application file for complete search history.

(56) References Cited

U.S. PATENT DOCUMENTS 3,534,444 A * 10/1970 Walker ..... D01G 15/34 19/95
3,543,444 A 12/1970 Mehta
4,135,068 A * 1/1979 Burns ..... B24C 7/00 451/99
5,024,029 A 6/1991 Abbott et al.
5,319,894 A 6/1994 Shank, Jr.
5,478,014 A 12/1995 Hynds
5,510,589 A * 4/1996 Arnal ..... H01H 13/50 200/522
8,961,271 B2 * 2/2015 Roden ..... B24C 7/00 451/39
2007/0181836 A1 8/2007 Nguyen
2012/0273701 A1 * 11/2012 Nguyen ..... F16K 35/025 251/98
2013/0157546 A1 * 6/2013 Roden ..... B24C 7/0046 451/101
2017/0225297 A1 * 8/2017 Trull, Jr. ..... B24C 7/0038
2018/0130613 A1 * 5/2018 Nguyen ..... H01H 13/506
2021/0331290 A1 * 10/2021 Mason ..... B05B 7/1463

* cited by examiner

*Primary Examiner* — David S Posigian
*Assistant Examiner* — Dana Lee Poon
(74) *Attorney, Agent, or Firm* — Kearney, McWilliams & Davis, PLLC; John M. DeBoer

(57) ABSTRACT

An abrasive blasting system that includes a blast hose, and a deadman assembly coupled with the blast hose. The deadman assembly further includes a primary deadman signal device and a secondary deadman signal device. The deadman also has a base frame, with each of the primary deadman signal device and the secondary deadman signal device coupled with the base frame. There is a trigger member movably coupled with the base frame, the trigger member configured to contact and move the primary deadman signal device to a signal-flow position, and also to contact and move the secondary deadman signal device to a secondary signal-flow position.

21 Claims, 19 Drawing Sheets

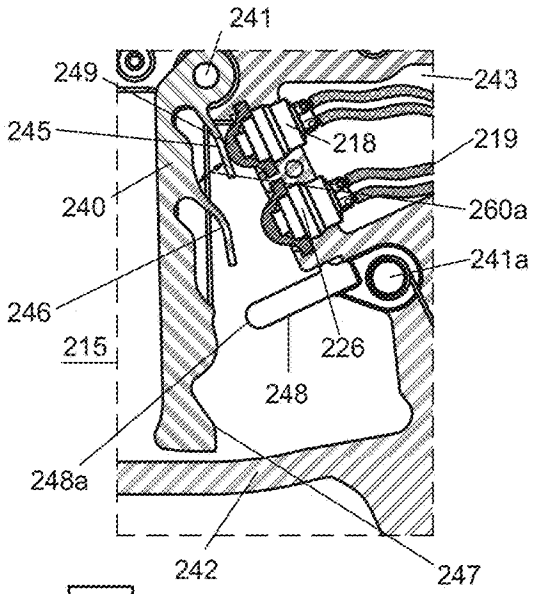
FIG. 2C
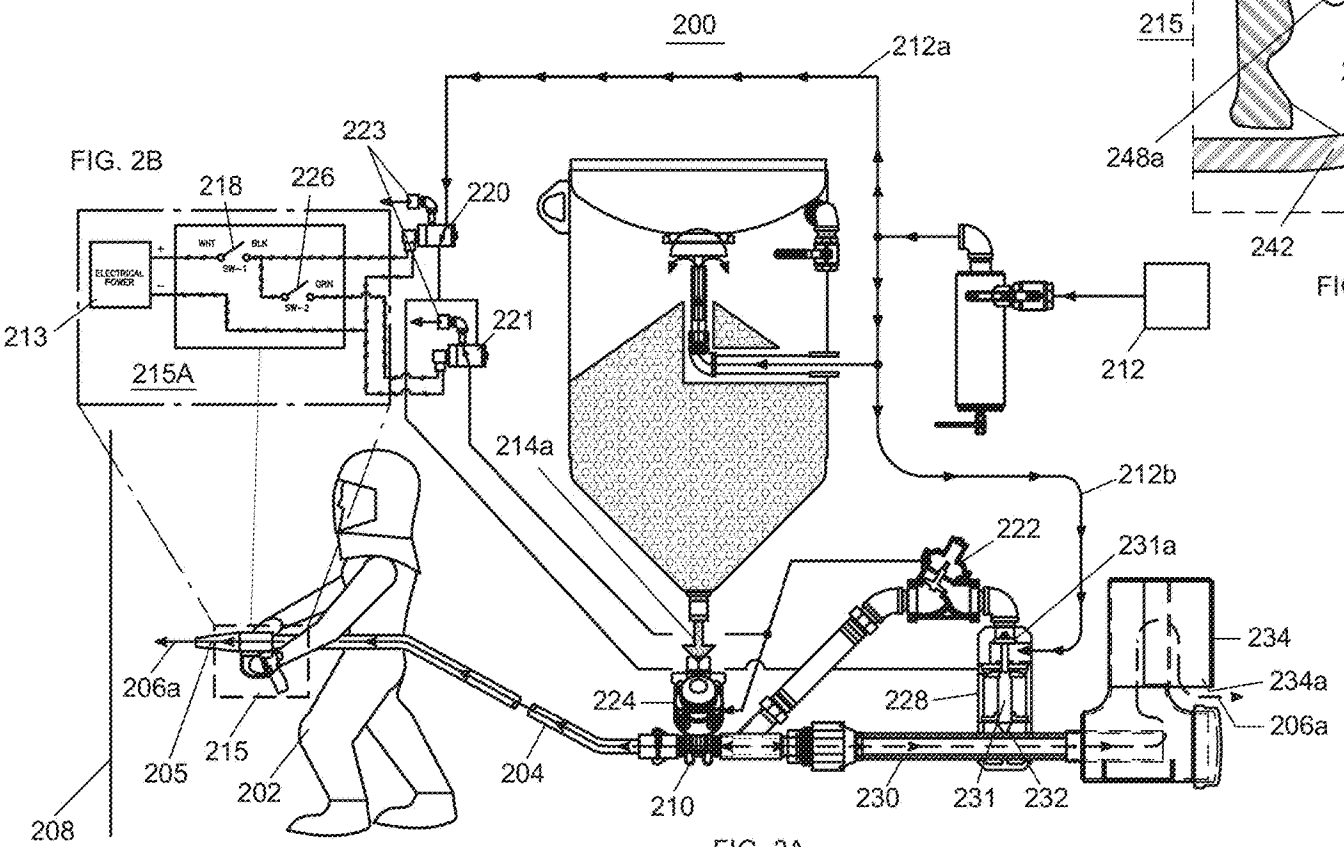
FIG. 2A
FIG. 2B

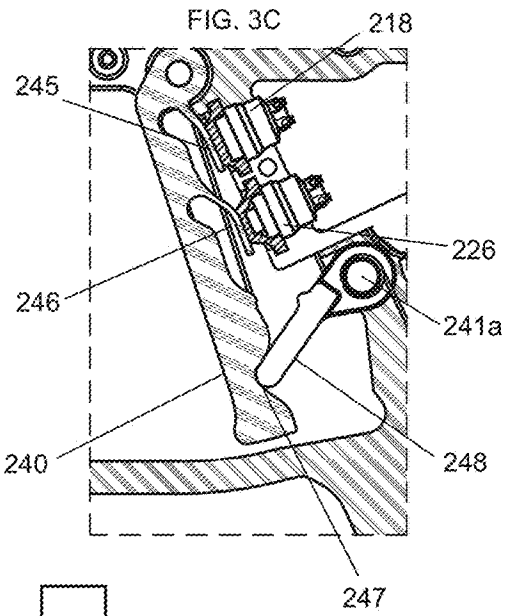
FIG. 3C
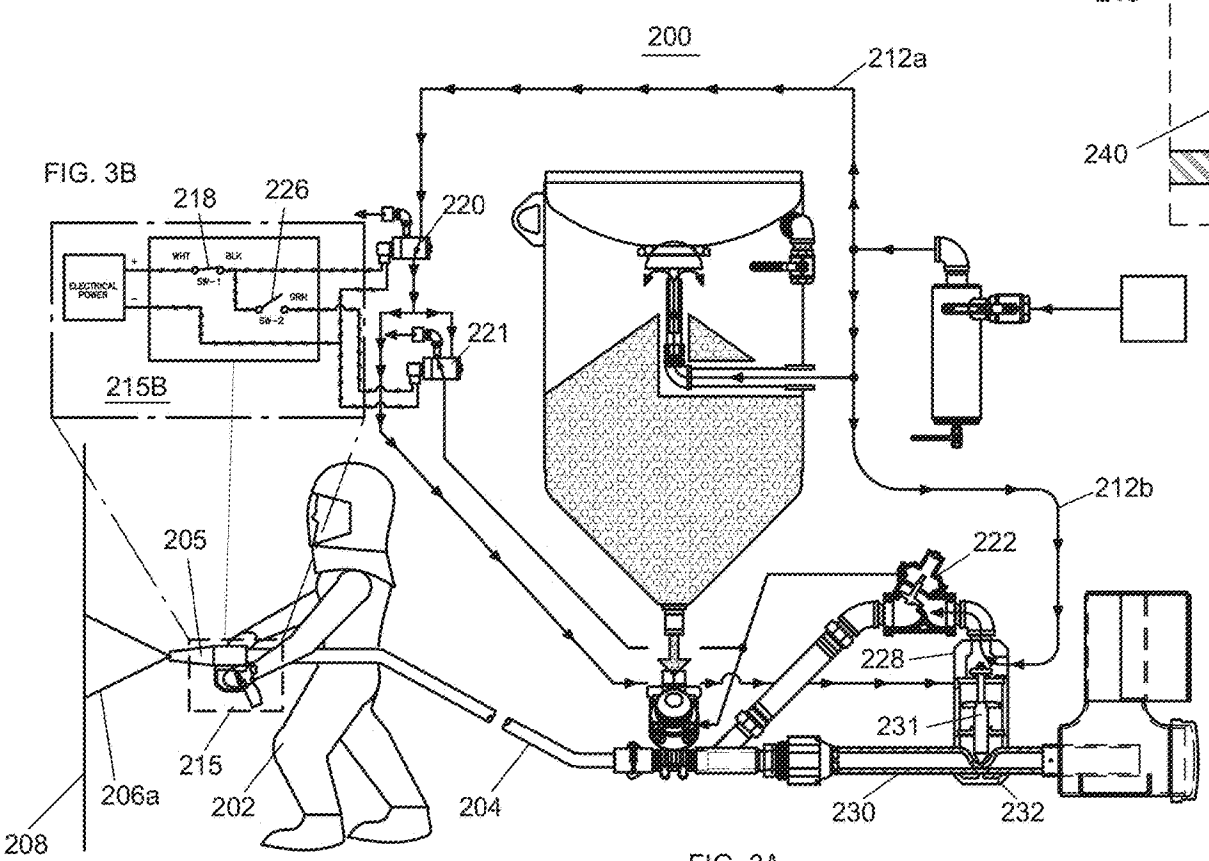
FIG. 3A
FIG. 3B

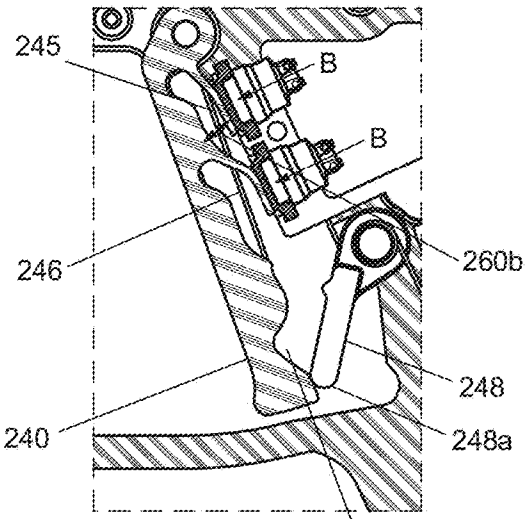
FIG. 4C
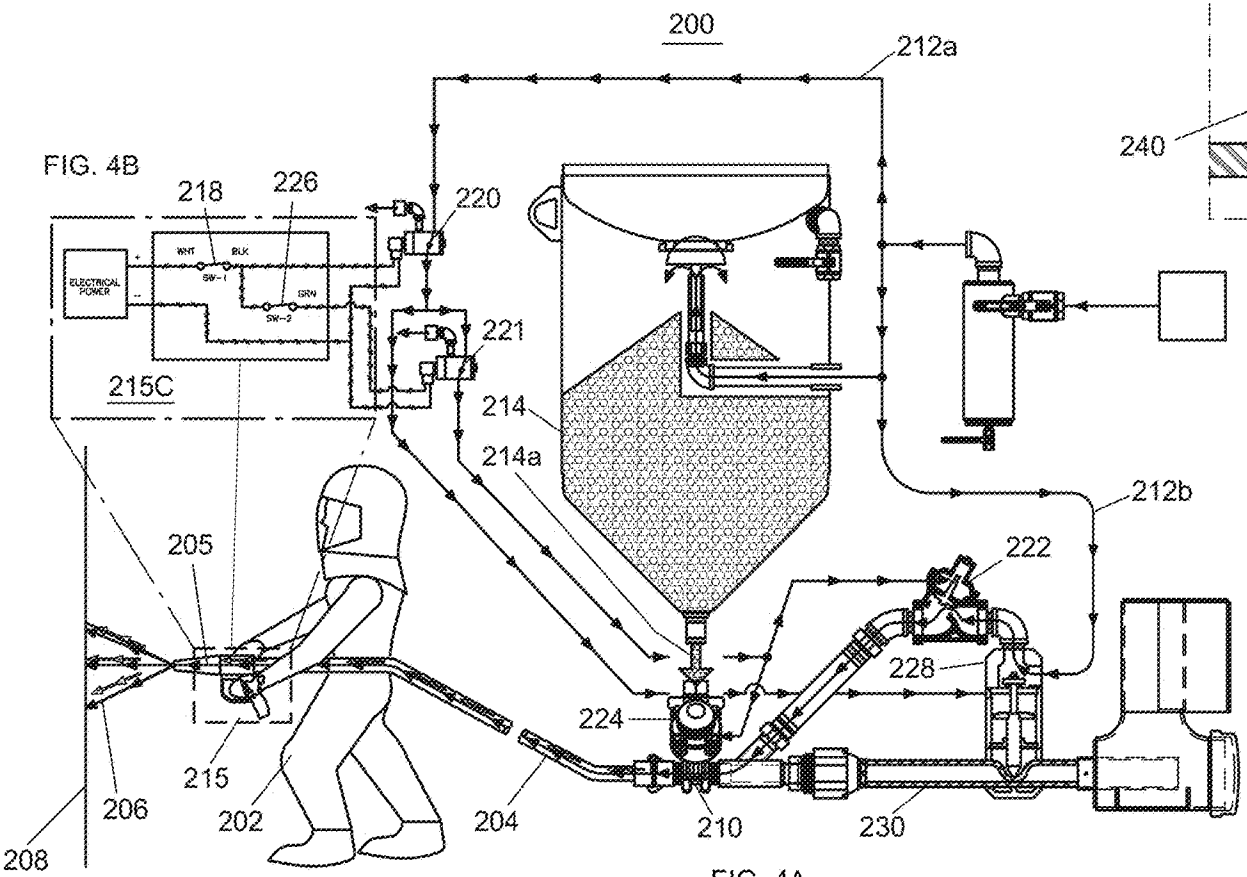
FIG. 4A
FIG. 4B

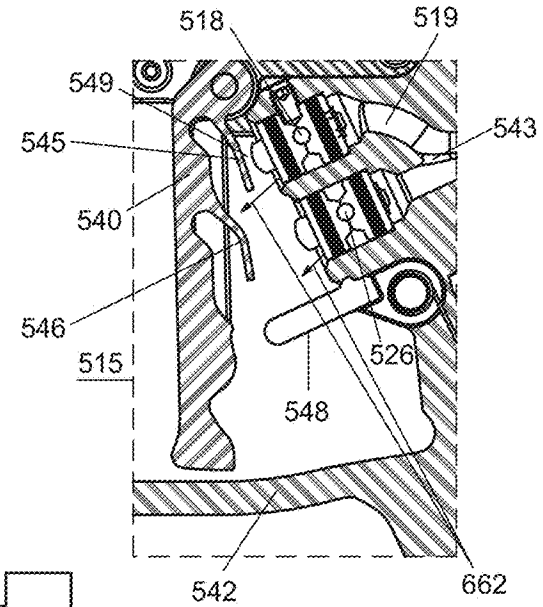
FIG. 5C
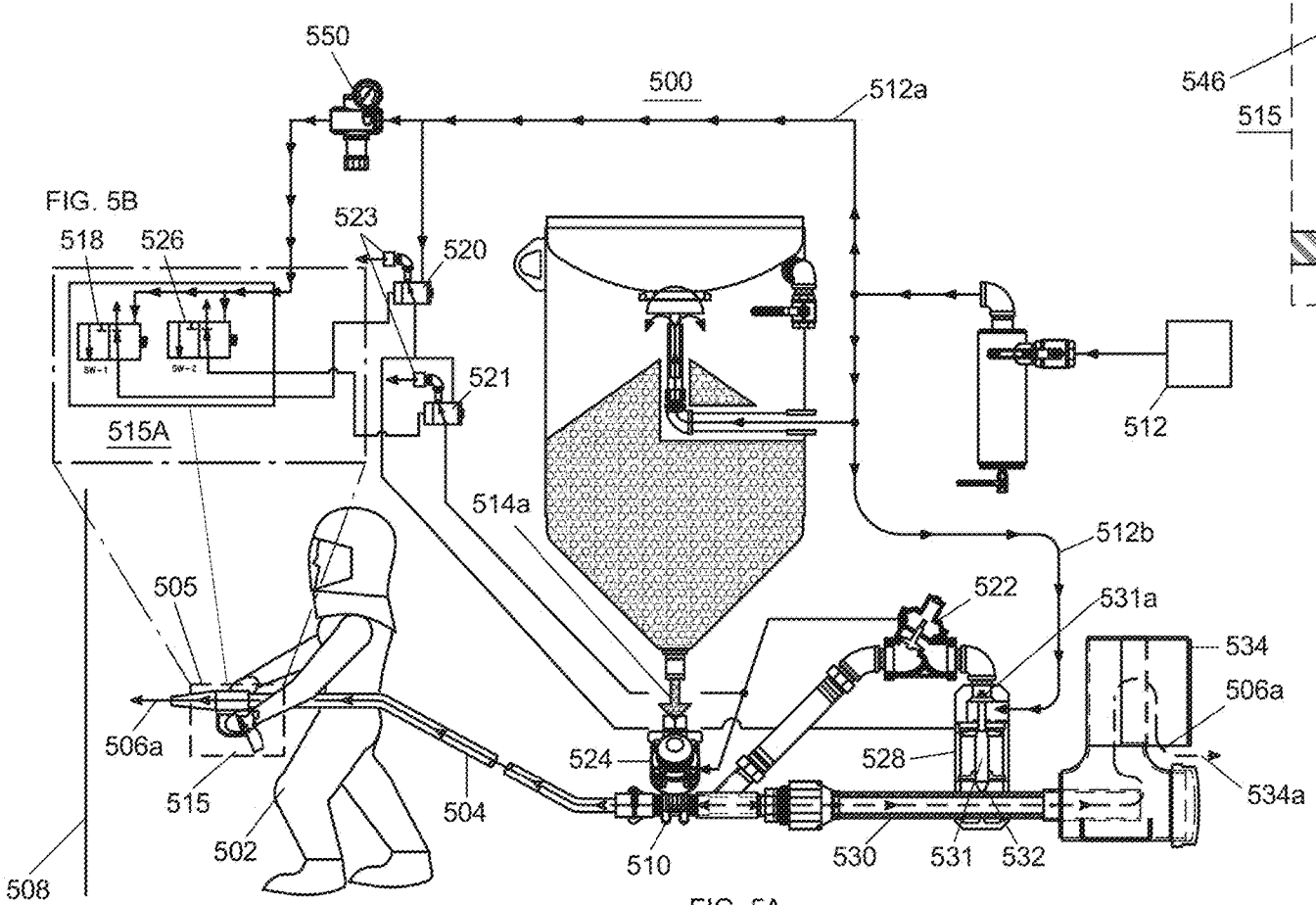
FIG. 5A
FIG. 5B 518
526
548
549
545
540
546
515
542

512
512b
534
532
522
528
531
530
512a
500
510
524
514a
520
521
523
550
504
502
515
505
506a
508
526
518
515B

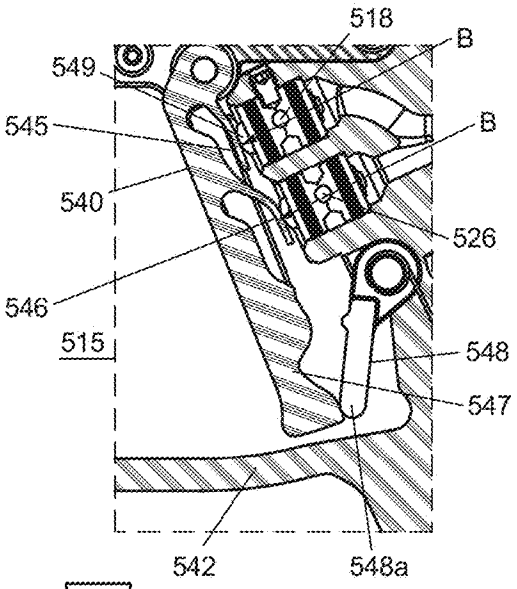
FIG. 7C
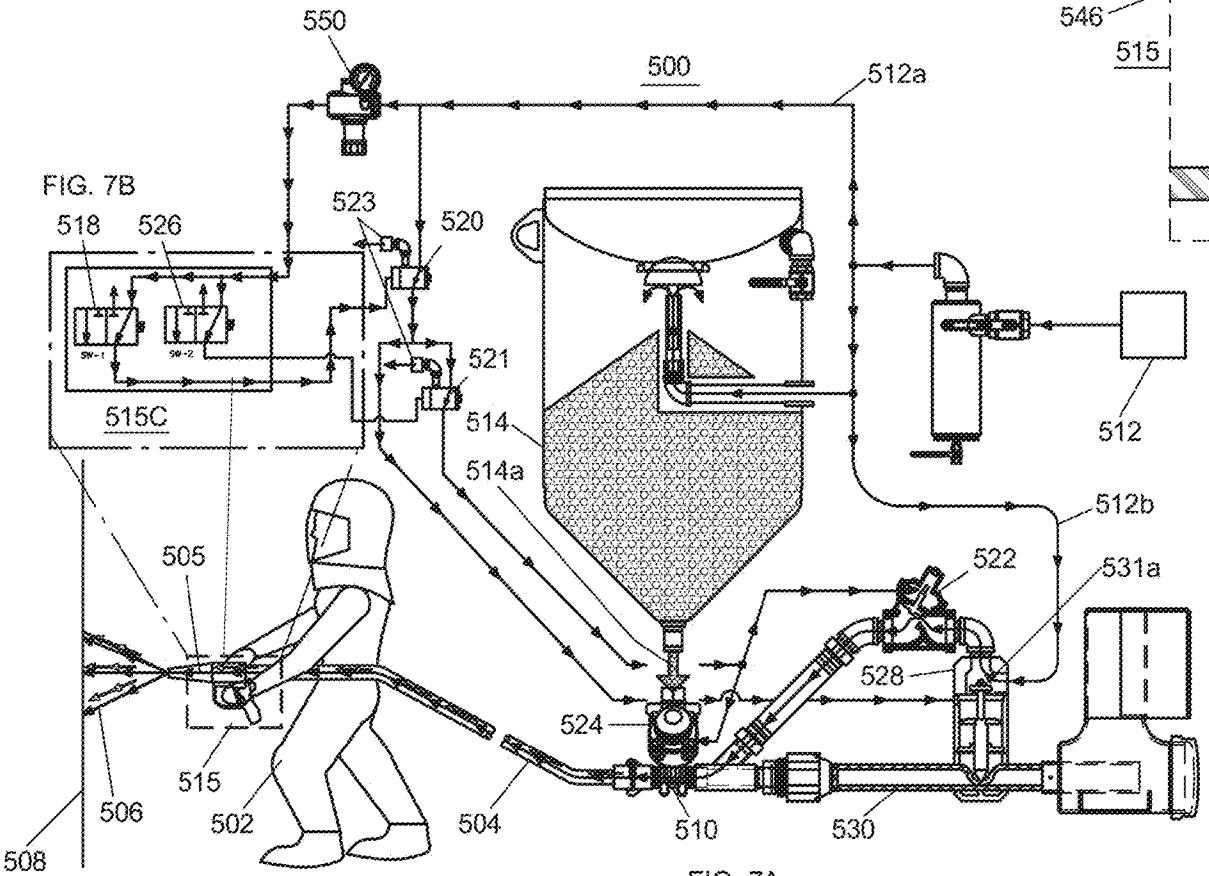
FIG. 7A
FIG. 7B

METHODS AND SYSTEMS FOR ABRASIVE BLASTING

BACKGROUND

Field of the Disclosure

This disclosure generally pertains to abrasive blasting, with related methods and systems, where the blasting may be wet, dry, or combinations thereof. More specifically, the disclosure relates to a multi-function deadman system or assembly. Other embodiments pertain to a quick-response blasting system.

Background of the Disclosure

Abrasive blasting is the process of forcibly propelling a high pressure, high velocity stream of abrasive material against a surface in order to smooth a rough surface, roughen a smooth surface, shape a surface, or remove surface materials, such as contaminants, paint, etc. The stream of abrasive material may be wet or dry.

FIG. 1 illustrates a typical abrasive blasting process (or system) 100. One particular process commonly known as sand-blasting (a form of dry media blasting) has been used for decades, to clean or otherwise prepare various types of structural surfaces. In this type of process 100, a supply of sand (or other types of particles, such as grit or the like) 114 is mixed with a fast-moving stream of air 112, usually in a mixer or valve 110. The sand particulate 114 becomes entrained in the air 112, and the resultant air-sand mixture 106 emerges at high speed from a nozzle 105 at the end of a blast hose 104. The mixture 106 is highly abrasive, and sand-blasting can be used to remove even strongly-adhered compounds (e.g., paint, etc.) from various types of structural surfaces 108.

The discharge of the air-sand mixture 106 is hazardous for multiple reasons. First, particulate from the discharge, and as well as the blasted-surface, will linger in the air in the form of a cloud 107, making breathing difficult. As such, a breathing hood or suit 101 may be worn by an operator 102 (the suit 101 may be fed breathing air 103). However, the suit 101 does not protect against the discharge from inadvertent handling of the blast hose 104.

When blasting at high pressures (100 psi or more), discharge 106 can reach speeds in excess of 500 mph, which means if the discharge 106 hits the operator 102, the impact may be deadly and as a minimum cause bodily injury by rapidly abrading soft human tissue. To mitigate or prevent gruesome injuries or death, a safety system may be utilized.

A typical deadman is an on/off system operable to quickly shutdown a hazardous piece of equipment in the event the operator loses engagement of the switch for any reason. The switch is associated with where the operator may hold the equipment, akin to the way one might hold a deadman handle of a lawnmower—when the mower deadman handle is released, a clutch is released, and the blade of the mower stops spinning. With regard to blast equipment, once the operator 102 releases the deadman (voluntarily or involuntarily), the flow of air and grit will cease via valve cut-off.

However, although the controlled air and grit valves will close, there is residual compressed air, laden with grit, contained in the blast hose downstream of the cut-off point that will continue to exhaust through the blast nozzle until the pressure inside the hose is equal to atmospheric pressure. The vent time will vary with the effective flow area of the nozzle and the volume of residual compressed air to be exhausted, and can take as much as ten seconds (or sometimes more) after release of the deadman switch to purge the system.

To address this timing problem, the Applicant developed a deadman system able to safely dissipate the residual compressed air through an ON/OFF combination valve configuration that simultaneously controlled the blast air and an exhaust (or vent) port. That is, when the deadman is released, the combination valve closes off the operational air blast feed, while simultaneously opening the vent port for the blast line.

Unfortunately, this deadman configuration resulted in undesired effects. First, there is an abrupt and violent release of compressed air and abrasive through the vent port that, while muffled, is extremely loud. While this might be a tolerable problem in the event of a rare-occurring emergency, the operational reality is that the deadman is frequently released for non-emergency purposes Second, although rapid dissipation is predominantly through the vent port, this system configuration still releases abrasive in areas proximate to the blasting equipment. Because this release occurs each and every time the operator releases the deadman (including for all non-emergency releases), abrasive accumulates or piles up around the blowdown muffler. This unintended consequence requires the operator to remove or reclaim the expended abrasive, resulting in wasted manhours.

As yet another problem, the exhaust hose wears at the pinch point of the combination valve. Over time, the pinch ram no longer seals or ruptures the hose, thereby requiring frequent replacement of the hose, thus adding more maintenance and potential for down time.

Finally, although an electric deadman is instantly responsive and provides the rapid shutdown benefit, not all hazardous areas are tolerable of electrical systems. While an electric deadman may provide an almost instantaneous signal to the control valves that in turn control downstream valves, the same cannot be said for a pneumatic deadman.

In a pneumatic deadman configuration, the twinline pressure is at the same pressure as the compressor, traditionally in the 100 to 150 psi range. The related control valves may have a spool shift, or activation/deactivation pressure setting range that leaves a large pressure gap that impacts vent time. Depending on twinline length, it could take four seconds or longer for the twinline pressure to reach the control valve deactivation pressure to signal downstream valves to start the emergency shutdown. Tragically, any delay in system reaction time increases the likelihood of injury.

A need exists in the art for an abrasive blasting system and process that may rapidly cease operation, and further has mitigated or reduced sound pollution, as well as provides an operator non-emergency capability that does not result in undesired buildup of expended abrasive. A need exists for an alternative to an electric deadman whereby a rapid response abrasive blasting system may be used in hazardous areas prohibitive to electrical components.

SUMMARY

Embodiments of the disclosure pertain to a pneumatic-controlled abrasive blasting system that may include any of: a blast hose; and a deadman assembly coupled with the blast hose. The deadman assembly may include a primary deadman signal device. There may be a secondary deadman signal device. The signal device may be a valve, switch, or other suitable device for transferring, controlling, etc. a signal. The signal devices may be activated through motion in a single or first direction of a trigger member. The signal devices may be deactivated through motion in an opposite or second direction of the trigger member.

The system may have an air source configured for fluid communication with one or both of the primary and secondary deadman signal devices and/or the blast hose.

Other embodiments of the disclosure pertain to an abrasive blasting system comprising that may include a blast hose coupled with a deadman assembly. The deadman assembly may include a primary deadman signal device, such as switch or a valve or the like. There may be a secondary deadman signal device. The assembly may have a base frame. One or both of the primary deadman signal device and the secondary deadman signal device may be coupled with the base frame.

The deadman assembly may have a trigger member movably coupled with the base frame. The trigger member may be to contact, engage, and/or otherwise move the primary deadman signal device to a signal-flow position. The trigger member may be able to do the same for the secondary deadman signal device via a respective signal-flow position.

The system may include an air source configured for fluid communication with the blast hose. There may be a primary control valve in signal communication with the primary deadman signal device and also in fluid communication with the air source. There may be a secondary control valve in signal communication with the secondary deadman signal device and also in fluid communication with the air source.

In aspects, the deadman assembly my have a lock flap movably engaged between the base frame and the trigger member. The lock flap may have a first lock flap position, as well as another lock flap position(s) different from the first lock flap position.

One or both of the primary and secondary deadman signal devices may be configured to transmit a control signal. When the lock flap is in the first lock flap position the trigger member may be prohibited from engaging the primary and secondary deadman signal devices. When the lock flap is in a position other than the first lock flap position, the trigger member may be not prohibited from engaging the secondary deadman signal device. The control signal may be electrical, pneumatic, etc.

The deadman assembly may have a (sloped) guard profile having a guard profile end, and a winged member having a winged member end proximate the guard profile end. From a rearward observation, the guard profile end may have a lateral profile radial greater than a lateral member radial of the winged member end.

In aspects, the first bias member may facilitate a range of motion of the trigger member while a first plunger is engaged with the primary signal device, and the primary signal device is in a signal flow position.

Still other embodiments of the disclosure pertain to a method of abrasive blasting that may include any of: providing a blast hose, the blast hose operatively configured with a deadman assembly; feeding an abrasive media to the blast hose; operating the deadman assembly in a manner to discharge the abrasive media from a spray nozzle end of the blast hose.

The deadman assembly may include one or both of a primary deadman signal device and a secondary deadman signal device. The assembly may have a base from with one or both of the primary deadman signal device and the secondary deadman signal device coupled therewith. There may be a trigger member pivotably coupled with the base frame, the trigger member configured to contact and move the primary deadman signal device to a signal-flow position, and/or to contact and move the secondary deadman signal device to a respective signal-flow position. There may be a lock flap movably engaged between the base frame and the trigger member.

Still other embodiments of the disclosure pertain to an abrasive blasting system that may include a blast coupled with a deadman assembly. The deadman assembly may include a primary deadman switch and a secondary deadman switch. The deadman assembly may have a base frame, with each of the primary deadman switch and the secondary deadman switch coupled with the base frame.

There may be a trigger member movably (such as pivotably) coupled with the base frame, the trigger member configured to contact and move the primary deadman switch to a signal-flow position, and also to contact and move the secondary deadman switch to a secondary signal-flow position.

The system may have an air source configured for fluid communication with the blast hose. There may also be a primary control valve in signal communication with the primary deadman switch and also in fluid communication with the air source and/or a secondary control valve in signal communication with the secondary deadman switch and also in fluid communication with the air source.

In yet other embodiments, there may be a method of abrasive blasting that includes providing a blast hose, the blast hose operatively configured with a deadman assembly. The deadman assembly may include a primary deadman switch and a secondary deadman switch. There may be a base frame, with each of the primary deadman switch and the secondary deadman switch coupled with the base frame; a trigger member pivotably coupled with the base frame, the trigger member configured to contact and move the primary deadman switch to a signal-flow position, and also to contact and move the secondary deadman switch to a respective signal-flow position; and a lock flap movably engaged between the base frame and the trigger member.

The method may include feeding an abrasive media to the blast hose; and operating the deadman assembly in a manner to discharge the abrasive media from a spray nozzle end of the blast hose. The method may include providing an air source configured in fluid communication with the blast hose. There may be a step of providing a primary control valve in signal communication with the primary deadman switch and also in fluid communication with the air source; and/or providing a secondary control valve in signal communication with the secondary deadman switch and also in fluid communication with the air source. The lock flap may have a first lock flap position, a second lock flap position and a third flap position.

In yet other embodiments, there may be a pneumatic-controlled abrasive blasting system that includes a blast hose coupled with a deadman assembly. The deadman assembly may further have a base frame; a primary deadman valve coupled with the base frame; and/or a secondary deadman valve coupled with the base frame.

There may be a trigger member pivotably coupled with the base frame, the trigger member further including one or both of a first plunger configured to contact and move the primary deadman valve to a signal-flow position; and a second plunger configured to contact and move the secondary deadman valve to a respective signal-flow position.

There may be a lock flap movably engaged between the base frame and the trigger member, the lock flap comprising a first lock flap position, a second lock flap position, and a third lock flap position. There may be an air source configured for fluid communication with each of the primary and secondary deadman valves. There may be a regulator valve disposed between the deadman assembly and the air source, and configured in fluid communication therewith.

The system may have a primary control valve in signal communication with the primary deadman valve and also in fluid communication with the air source. The system may have a secondary control valve in signal communication with the secondary deadman valve and also in fluid communication with the air source.

One or both of the primary control valve and the secondary control valve may have a respective activation pressure setting and deactivation pressure setting.

In aspects, the primary control valve may have an internal mechanism configured to open or close the primary control valve, wherein movement of the internal mechanism to a closed position may be air-assisted. In comparable aspects, the secondary control valve may include a respective internal mechanism configured to open or close the secondary control valve. Movement of the respective internal mechanism to its closed position may be air-assisted.

In still yet other embodiments of the disclosure, there may be a pneumatic-controlled abrasive blasting system that may include a blast hose coupled with a deadman assembly. The deadman assembly may have a base frame; a primary deadman valve coupled with the base frame; and/or a secondary deadman valve coupled with the base frame.

There may be a trigger member movably (such as pivotably) coupled with the base frame. The trigger member may have a first plunger configured to contact and move the primary deadman valve to a signal-flow position. The trigger member may have a second plunger configured to contact and move the secondary deadman valve to a respective signal-flow position. The signal-flow positions may be an 'open' position of the valves.

The deadman may have a lock flap movably engaged between the base frame and the trigger member, the lock flap comprising a first lock flap position, a second lock flap position, and a third lock flap position.

The system may have an air source configured for fluid communication with each of the primary and secondary deadman valves and the blast hose. There may be a regulator valve disposed between the deadman assembly and the air source. There may be an intermediate regulator valve disposed between the air source and the regulator valve. There may be a primary control valve in signal communication with the primary deadman valve and also in direct fluid communication with the air source and the intermediate regulator valve. There may be a secondary control valve in signal communication with the secondary deadman valve and also in direct fluid communication with the air source and the intermediate regulator valve.

One or both of the primary control valve and the secondary control valve may include a respective activation pressure setting and deactivation pressure setting. In aspects, the regulator valve may be configured to reduce the pressure of airflow to the deadman assembly.

Yet other embodiments of the disclosure may pertain to a deadman assembly having a primary deadman signal device and a secondary deadman signal device. The deadman assembly may thus be multi-purpose, multi-position in nature.

The assembly have a base frame. In aspects, each of the primary deadman signal device and the secondary deadman signal device may be coupled with the base frame. There may be a trigger member movably coupled with the base frame, the trigger member configured to contact and move the primary deadman signal device to a signal-flow position, and also to contact and move the secondary deadman signal device to a respective signal-flow position;

The deadman assembly may include a lock flap movably engaged between the base frame and the trigger member. The lock flap may be configured to move between a first lock flap position and another lock flap position.

There may be first bias member that facilitates a range of motion of the trigger member while a first plunger is engaged with the primary signal device, and while the primary signal device is in a signal flow position. The trigger member may be configured for a range of motion while the primary signal device is held in a signal flow position. The trigger member may be movable in range of motion while a first plunger is engaged with the primary signal device, and the primary signal device is in a signal flow position. The first bias member may facilitate a range of motion of the trigger member while a first plunger is engaged with the primary signal device, and the primary signal device is in a signal flow position.

Yet other embodiments of the disclosure pertain to a pneumatic-controlled abrasive blasting system that may include one or more of: a blast hose; a deadman assembly; an air source, a regulator valve; and a primary control valve.

The deadman assembly may be coupled with the blast hose. The assembly may include: a base frame; a primary deadman valve coupled with the base frame; a secondary deadman valve coupled with the base frame; and a trigger member pivotably coupled with the base frame.

The trigger member may include a first plunger configured to contact and move the primary deadman valve to a signal-flow position. The trigger member may include a second plunger configured to contact and move the secondary deadman valve to a respective signal-flow position. The trigger member may include a lock flap movably engaged between the base frame and the trigger member, the lock flap comprising a first lock flap position, a second lock flap position, and a third lock flap position.

The air source may be configured for fluid communication with one or both of the primary and secondary deadman valves.

The regulator valve may be disposed between the deadman assembly and the air source. The regulator valve may be configured in fluid communication therewith.

There may be an intermediate regulator valve disposed between the regulator valve and the air source. The intermediate regulator valve may be configured for fluid communication with one or both of the regulator valve and the air source.

The primary control valve may be in signal communication with the primary deadman valve and also in fluid communication with the air source. The secondary control valve may be in signal communication with the secondary deadman valve and also in fluid communication with the air source.

One or both of the primary control valve and the secondary control valve may have a respective activation pressure setting and deactivation pressure setting.

The primary control valve may include an internal mechanism configured to open or close the primary control valve. Movement of the internal mechanism to a closed position may be air-assisted. The secondary control valve may include a respective internal mechanism configured to open or close the secondary control valve. Movement of the respective internal mechanism to its closed position may be air-assisted.

The intermediate regulator may provide an intermediate regulated pressure to each of the primary control valve and the secondary control valve to facilitate the air-assisted movement of the respective internal mechanisms.

The regulator valve may be configured to further reduce the intermediate regulated pressure of airflow to the deadman assembly, whereby upon transfer, a pressure differential of signal air between at least one of the primary and secondary deadman valves, and the respective primary and secondary control valve deactivation pressure setting, is in the range of at least 1 psi above the activation pressure setting to not more than 60 psi above the deactivation pressure setting. One or both of the primary and secondary deadman valves may be configured to transmit a control signal to the respective downstream control valves.

When the lock flap is in the first lock flap position, the first and second plungers may be prohibited from opening the first and second deadman valves. When the lock flap is in the second lock flap position, the second plunger may be prohibited from opening the secondary deadman valve. When the lock flap is moved to the third lock flap position, the second plunger may not be prohibited from opening the secondary deadman valve.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein:

FIG. 2A shows a process diagram view of an abrasive blasting system in a no-blast or emergency shutdown mode according to embodiments of the disclosure;

FIG. 2B shows a logic view of a signal device assembly configuration for the no-blast or emergency shutdown mode of FIG. 2A according to embodiments of the disclosure;

FIG. 2C shows a close-up side cross-sectional view of a deadman assembly for the no-blast or emergency shutdown mode of FIG. 2A according to embodiments of the disclosure;

FIG. 3A shows a process diagram view of an abrasive blasting system in a no-blast, nozzle-vent mode according to embodiments of the disclosure;

FIG. 3B shows a logic view of a signal device assembly configuration for the no-blast, nozzle-vent mode of FIG. 3A according to embodiments of the disclosure;

FIG. 3C shows a close-up side cross-sectional view of a deadman assembly for the no-blast, nozzle-vent mode of FIG. 3A according to embodiments of the disclosure;

FIG. 4A shows a process diagram view of an abrasive blasting system in a blast mode according to embodiments of the disclosure;

FIG. 4B shows a logic view of a signal device assembly configuration for the blast mode of FIG. 4A according to embodiments of the disclosure;

FIG. 4C shows a close-up side cross-sectional view of a deadman assembly for the blast mode of FIG. 4A according to embodiments of the disclosure;

FIG. 5C shows a close-up side cross-sectional view of a deadman assembly for the no-blast or emergency shutdown mode of FIG. 5A according to embodiments of the disclosure;

FIG. 5AA shows a process diagram view of a pneumatic abrasive blasting system having a balanced/imbalanced valve configuration according to embodiments of the disclosure;

FIG. 5BB shows a logic view of a valve assembly configuration for the blasting system of FIG. 5AA according to embodiments of the disclosure;

FIG. 7A shows a process diagram view of a pneumatic abrasive blasting system in a blast mode according to embodiments of the disclosure;

FIG. 7B shows a logic view of a valve assembly configuration for the blast mode of FIG. 7A according to embodiments of the disclosure;

FIG. 7C shows a close-up side cross-sectional view of a deadman assembly for the blast mode of FIG. 7A according to embodiments of the disclosure;

DETAILED DESCRIPTION

Figure 1:
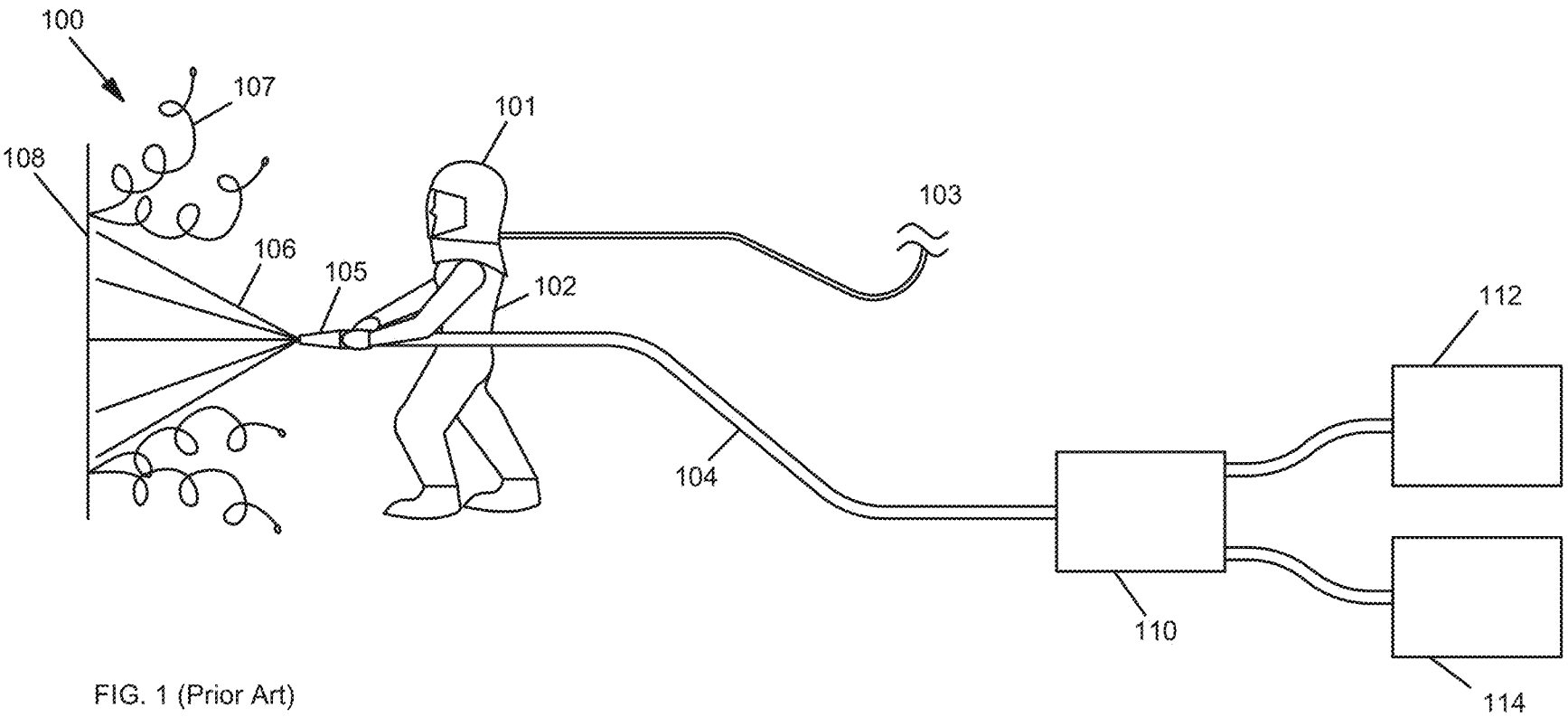
FIG. 1 (Prior Art)
FIG. 1 shows a general side view of a conventional blasting system.

Regardless of whether presently claimed herein or in another application related to or from this application, herein disclosed are novel apparatuses, units, systems, and methods that pertain to abrasive blasting, details of which are described herein.

Embodiments of the present disclosure are described in detail with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," etc., are used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components to be new, used, and/or retrofitted to existing machines and systems.

Various equipment may be in fluid communication directly or indirectly with other equipment. Fluid communication may occur via one or more transfer lines and respective connectors, couplings, valving, piping, and so forth. Fluid movers, such as pumps, may be utilized as would be apparent to one of skill in the art.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, melt index, etc., is from 100 to 1,000. it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure. Numerical ranges are provided within this disclosure for, among other things, the relative amount of reactants, surfactants, catalysts, etc. by itself or in a mixture or mass, and various temperature and other process parameters.

Terms

The term "connected" as used herein may refer to a connection between a respective component (or subcomponent) and another component (or another subcomponent), which may be fixed, movable, direct, indirect, and analogous to engaged, coupled, disposed, etc., and may be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "pipe", "conduit", "line", "tubular", or the like as used herein may refer to any fluid transmission means, and may (but need not) be tubular in nature. The term may also apply to other forms of transmission, such as electrical.

The term "composition" or "composition of matter" as used herein may refer to one or more ingredients, components, constituents, etc. that make up a material (or material of construction). Composition may refer to a flow stream of one or more chemical components.

The term "utility fluid" as used herein may refer to a fluid used in connection with the operation of an abrasive blasting device, such as a grit (sand), air, or water. The utility fluid may be for blasting, heating, cooling, or other type of utility. 'Utility fluid' may also be referred to and interchangeable with 'service fluid' or comparable.

The term "mounted" as used herein may refer to a connection between a respective component (or subcomponent) and another component (or another subcomponent), which may be fixed, movable, direct, indirect, and analogous to engaged, coupled, disposed, etc., and may be by screw, nut/bolt, weld, and so forth.

The term "non-emergency release" as used herein may refer to a voluntary release of a trigger/level mechanism of a deadman assembly in order to accomplish some other task, such as a break for shift change, a meal, or visit to a restroom, or to reposition for blasting a new area.

The term "deadman" as used herein may refer to an operable system or assembly utilizing some form of signal device or comparable mechanism that, upon release of the 'deadman', results in shutdown. With respect to a blasting operation, release of the deadman may refer to a shutdown of media transfer through a blast line.

The term "signal device" as used herein may refer generally to a device suitable for, other otherwise configured to, be associated with transmission, transfer, go/nogo, etc. of a signal. The signal may be a control signal. The signal may be pneumatic, electrical, etc.

The term "control valve" as used herein may refer to a valve configured to control flow of a fluid, a solid, a slurry, etc. through the valve by varying the size of the flow passage as directed by a signal from a controller. The opening or closing of a control valve may be by electrical, hydraulic, or pneumatic actuators, or the like. The control valve may receive a signal from a deadman assembly in order to control other valves such as metering, combination or air valves.

The term "pneumatic" as used herein may refer to a device or piece of equipment operable or otherwise responsive to some form of air (or other suitable gas) pressure.

The term "metering valve" as used herein may refer to a type of valve associated with a solid, such as sand, grit, and the like. Such a valve may be multi-function. For example, the metering valve may control flow of the solid into a compressed air stream. Another function may be to regulate the solid flow by changing the orifice size in the valve body. The larger the orifice the greater the solids flow.

The term "imbalanced valve" as used herein may refer to a type of valve configured with a movable internal mechanism that may be air-assisted in its movement. For example, the moveable internal mechanism may be a spring biased spool, whereby the spool may move based on the spring, as well as fluid pressure (i.e., air) thereagainst.

The term "balanced valve" as used herein may refer to a type of valve configured with a movable internal mechanism that is not air-assisted in its movement. For example, the moveable internal mechanism may be a spring biased spool, whereby the spool may move based solely on the spring.

The term "twinline" as used herein may refer to a dual-configured hose having a supply side hose and signal side hose that are attached together in a way to form a "twinline". The supply side air may be connected to air piping and the pneumatic deadman control switch. As such, when the deadman lever is depressed, or activated, the switch port may be opened and the compressed air may then flow into the signal side hose of the twinline. This signal may be carried or otherwise transferred to the control system on the abrasive unit to activate air and abrasive controls. Embodiments herein may utilize a multi-hose configuration that may include a 'twinline', as well as one or more additional hoses (e.g., 3 hoses).

The term "pinch valve" or "pinch ram valve" may refer to a multi-direction (e.g., 2-way) valve operable to shut-off or control the flow of compressed air and/or corrosive, abrasive or granular media. The valve may utilize pressurized air to open or close. In the open position, the valve may have no restriction, and thus allows a wide range of compressed air and/or media to pass through its bore. The closed position may result in no flow through its bore. There may be a "shut off" valve.

The term "activation" may refer to a valve configuration that entails a set point or other determined point where an inner mechanism shifts, such as to allow a fluid to flow, whereas without activation, the fluid flow is prevented.

The term "deactivation" may refer to a valve configuration that entails a set point or other determined point, where an inner mechanism shifts, such as to stop or prevent a fluid from flowing, whereas without deactivation, the fluid is able to flow. A valve may have an activation setting and a deactivation setting, which may be different or unequal. Thus, for example, a valve may move below its activation setting, yet remain activated as the deactivation setting is not yet reached.

Referring now to FIGS. 2A, 2B, and 2C together, a process diagram view of an abrasive blasting system in a no-blast or emergency shutoff mode, a logic view of a signal device assembly configuration, and a close-up side cross-sectional view of a deadman assembly, respectively, illustrative of embodiments disclosed herein, are shown.

FIGS. 2A-2C illustrate an abrasive blasting system 200 for use in treating a surface 208. As shown here, the blasting system 200 may be in a no-blast or emergency shutdown mode or configuration, which normally entails an operator 202 releasing (or otherwise not squeezing/engaging) a deadman assembly 215. The system 200 may be vented, in that an exhaust or vent line 230 is open.

The deadman assembly 215 may be associated with signal device logic 215A shown in FIG. 2B, which may be in operable communication with a power source 213. Although shown here as an electrical configuration, embodiments herein are not meant to be limited, and other power configurations for the deadman assembly 215 (and system 200) are possible, such as pneumatic, hydraulic, and so forth.

The deadman assembly 215 may be suited for applications that permit a blast nozzle 205 (or an area proximate thereto) to be held by an operator 202 facing forward during operation. As shown here, when a trigger or lever 240 is in an unengaged (or unsqueezed, etc.) or released position (FIG. 2C) a primary deadman signal device 218 and a secondary deadman signal device 226 may be in a corresponding open or unengaged position. In embodiments, one or both of the primary deadman signal device 218 and the secondary deadman signal device 226 may have a normally open configuration.

While described as 'open' here, the crux of FIG. 2B illustrates that a control signal may be withheld or otherwise disabled in a manner that the signal does not communicate past the controllers 220, 221. As such, when the deadman signal devices 218, 226 are open, respective controllers 220 and 221 prevent an airflow signal 212*a* from transferring from airflow source 212 to respective downstream valves. The airflow signal to the combo, metering and air valves 228, 224, 222 may be vented through vents 223.

Air source 212 may be in fluid communication with multiple flow paths. For example, source 212 may provide control valve air source 212*a*, as well as blast air source 212*b*. Air source 212*a* may feed control valves 220, 221. When control valve 220 is activated, the valve 220 may signal the combo valve 228 to open air flow to blast air valve 222 and supplies air to control valve 221. When control valve 220 is deactivated, the signal air to the combo valve 228 and supply air to control valve 221 may be vented from control valve vent 223.

In this respect, the primary controller 220 may prevent airflow 212*a* from transferring to combination valve 228. 'Combination valve' in this sense means the valve 228 may have a combined dual function associated with it, such as controlling blast air 212*b*, while at the same time pinching/unpinching the exhaust line 230 in an area proximate to pinch point 232. As shown here, a ram 231 may be in a normally open position when airflow 212*a* is withheld from the valve 228. At the same time, valve end 231*a* may be closed, therefore preventing blast air 212*b* to flow to the air valve 222.

In a similar vein the secondary controller 221 may prevent airflow 212*a* from transferring. As shown here, the blast air valve 222 and the metering valve 224 may be in a normally closed position, whereby blast air 212*b* and (dry) media 214*a* are prevented from entering mixing zone or region 210.

Either of the controllers 220, 221 may be solenoid-type valves, such as an electrically-operated valve. In this respect, the controllers 220, 221 may configured as a valve that uses electromagnetic force (electric signal) to operate. That is, when an electrical current is passed through a solenoid coil of the valve, a magnetic field is generated which causes a ferrous metal rod to move (not viewable here). When the rod moves, it may open up the port whereby supply airflow 212*a* becomes akin to signal air. When the signal is removed, such as when the deadman 215 is released, the port may close as a result of a bias member. This configuration constitutes a normally closed control valve. Normally open control valve would have the port from supply air to the signal air open unless the control valve receives an electrically signal. As such, one or both of the controllers 220, 221 may have a normally closed configuration.

In the event the deadman assembly 215 was previously engaged, but then released, there may be residual flow 206*a* within the blast line 204. However, as the exhaust line 230 may be unpinched, residual flow 206*a* may exit an outlet 234*a* of a muffler 234. The exhaust line 230, muffler 234, and outlet 234*a* may be sized and otherwise configured to promote rapid dissipation therethrough of any residual flow 206*a*.

A close-up view of the deadman assembly 215 in the no-blast or emergency shutdown configuration may be seen in FIG. 2C, which illustrates primary and secondary deadman signal devices 218 and 226 in their unengaged (or open) positions. The trigger 240 may be movingly (such as pivotably) coupled with the frame 242, such as at pivot point 241. The trigger 240 may be biased away from engaging the deadman signal devices 218, 226, such that an amount of squeezing force may be needed in order to move the trigger 240.

Any initial attempt to squeeze the trigger 240 may be impeded by coming into contact with an end 248*a* of a lock flap 248. The lock flap 248 may be movingly (such as pivotably) coupled with the frame 242, such as at pivot point 241*a*. The lock flap 248 may have a first position. The first position of the lock flap 248 may prevent the trigger (or respective cantilever tabs) from engaging (closing) the deadman signal devices 218, 226. The lock flap 248 may be biased (such as with a spring) to the first position.

Either or both of the signal devices may be protected via a sheathing 249. The deadman signal devices 218, 226 may be coupled with the logic circuit (215A-C) and respective controllers via wiring, lines, infrared, or other suitable signal transmission configuration. As shown here, wiring 219 may be disposed within a device cavity 243. The cavity 243 may be enclosed in order to prevent or mitigate against the presence of debris, particulate, etc.

Referring now to FIGS. 3A, 3B, and 3C together, a process diagram view of an abrasive blasting system in a no-blast, nozzle-vent mode, a logic view of a signal device assembly configuration, and a close-up side cross-sectional view of a deadman assembly, respectively, illustrative of embodiments disclosed herein, are shown.

FIGS. 3A-3C illustrate the abrasive blasting system 200 for use in treating the surface 208 moved to a no-blast, nozzle-vent mode (or sometimes non-emergency). As shown here, this mode normally entails an operator 202 partially releasing the deadman assembly 215 in a manner whereby the trigger/lever 240 may energize the primary signal device 218, but is prohibited from doing the same for the secondary signal device 226. This results in logic configuration 215B.

As the controller 220 may now be open, airflow 212*a* may be transferred to the combo valve 228 in sufficient enough manner to move (urge) the ram 231 ram against the exhaust line 230 at pinch point 232, thereby 'closing' off the line 230.

In normal operation, the operator 202 may be engaged in blast mode (see FIGS. 4A-4C), but then desires a non-emergency release, whereby the line 230 stays closed, and any remnant air and media 206*a* is released out of the nozzle 205. Although theoretically the Figures may also represent the temporal shift from the no-blast mode (of FIGS. 2A-2C), there would be limited functionality as there is likely to be no sustainable (residual) air in the blast hose. As such, FIGS. 3A-3C may generally represent the shift from the blast mode (of FIGS. 4A-4C) to a non-emergency (partial) release of the deadman assembly 215.

Only when the operator 202 manually toggles a lock flap 248 out of the way of the handle 240 will the operator 202 be able to fully squeeze the handle 240 in order to engage/close secondary deadman signal device 226 (and thus move back to blast mode—FIG. 4C). Otherwise, as shown here in FIG. 3C, the lock flap 248, while no longer in the first position (FIG. 2C), may be configured to prohibit the movement of the handle 240 in order to engage the secondary deadman signal device 226 (but yet able to engage the primary deadman signal device 218). The lock flap 248 may have an intermediate or second position that allows the trigger to engage primary deadman signal device 218, but not engage the secondary deadman signal device 226.

For example, an end 248*a* of the lock flap 248, by being moved into recess 247, may be engaged with and prevent movement of the handle 240 from the position shown in FIG. 3C in order to initiate the blast mode (4C). The only way to initiate blast mode is to (manually) move the lock flap 248 out of the way (via pivot connection point 241*a*), which means further moving the end 248*a* out of the recess 247. Only then may the handle 240 now freely move (via pivot connection point 241) toward the secondary deadman signal device 226. But unless and until this action occurs, or the handle 240 is released, the deadman assembly 215 may remain in the no-blast, nozzle-vent mode.

Referring now to FIGS. 4A, 4B, and 4C together, a process diagram view of an abrasive blasting system in a blast mode, a logic view of a signal device assembly configuration, and a close-up side cross-sectional view of a deadman assembly, respectively, illustrative of embodiments disclosed herein, are shown.

FIGS. 4A-4C illustrate the abrasive blasting system 200 for use in treating the surface 208 moved to a blast mode. As shown here, this mode normally entails an operator 202 fully engaging the deadman assembly 215 in a manner whereby the trigger/lever 240 may energize each of the primary deadman signal device 218 and the secondary deadman signal device 226, as indicated by depressed device arrows B. This may only occur then the operator 202 manually moves an end 248*a* of lock flap 248 out of the way (whereby the end 248*a* may be moved further out of or beyond recess 247). When the deadman signal devices 218 and 226 are engaged, the system 200 may have the logic configuration 215C.

It would be appreciated that in order to accomplish a multi-device, multi-position configuration of the deadman assembly 215, particular attention may need be paid to how the trigger 240 interacts with the deadman signal devices 218, 226. It was unexpectedly discovered that some amount of overtravel for one or more of the cantilever tabs 245, 246 may be useful. Overtravel may be referred to as the amount of added distance an actuator moves after the operating position is achieved.

In embodiments, it may be desirous for the devices to be aligned in such a way that the secondary deadman signal device 226 is in pretravel while the primary deadman signal device 218 is activated. As an example, if there is no cantilever tab configured for overtravel: When the primary deadman signal device 218 is activated, pretravel 0.07", the secondary deadman signal device 226 may have to be at pretravel 0.06" for the 0.01" overtravel in primary signal device to allow activation of secondary at pretravel 0.07". Any movement by the operator would cause secondary signal device to toggle on and off.

By the addition of the configured cantilever tabs 245, 246, the overtravel in primary and secondary signal devices may be increased allowing the secondary deadman signal device 226 to have "play" so small movements in the lever or trigger 240 will not result in unwanted deactivation of the secondary deadman signal device 226. In comparison, FIG. 2C shows the cantilever tab 245 having an undeflected gap 260*a*, whereas FIG. 4C shows the cantilever tab 245 having an overtraveled position gap 260*b*.

The closing of the secondary deadman signal device 226 results in activation of the secondary controller 221 in manner whereby signal airflow 212*a* may now transfer to the air valve 222 and the metering valve 224. Once the air valve 222 opens, blast air 212*b* may flow through the valve 222 toward mixer 210. In a similar manner, once the media valve 224 opens, media 214*a* may transfer from media storage 214, through the valve 224, and into mixer 210.

As the vent line 230 remains closed (pinched) [via primary deadman signal device 218 engaged and primary controller 220 transferring signal air to combo valve 228], the only path for the mixed air and media 206 is through hose 204 and out of the nozzle 205. The blast media 206 impacts against the surface 208 to accomplish the desired blasting outcome.

Pneumatic Control

Figures 5A, 5B:
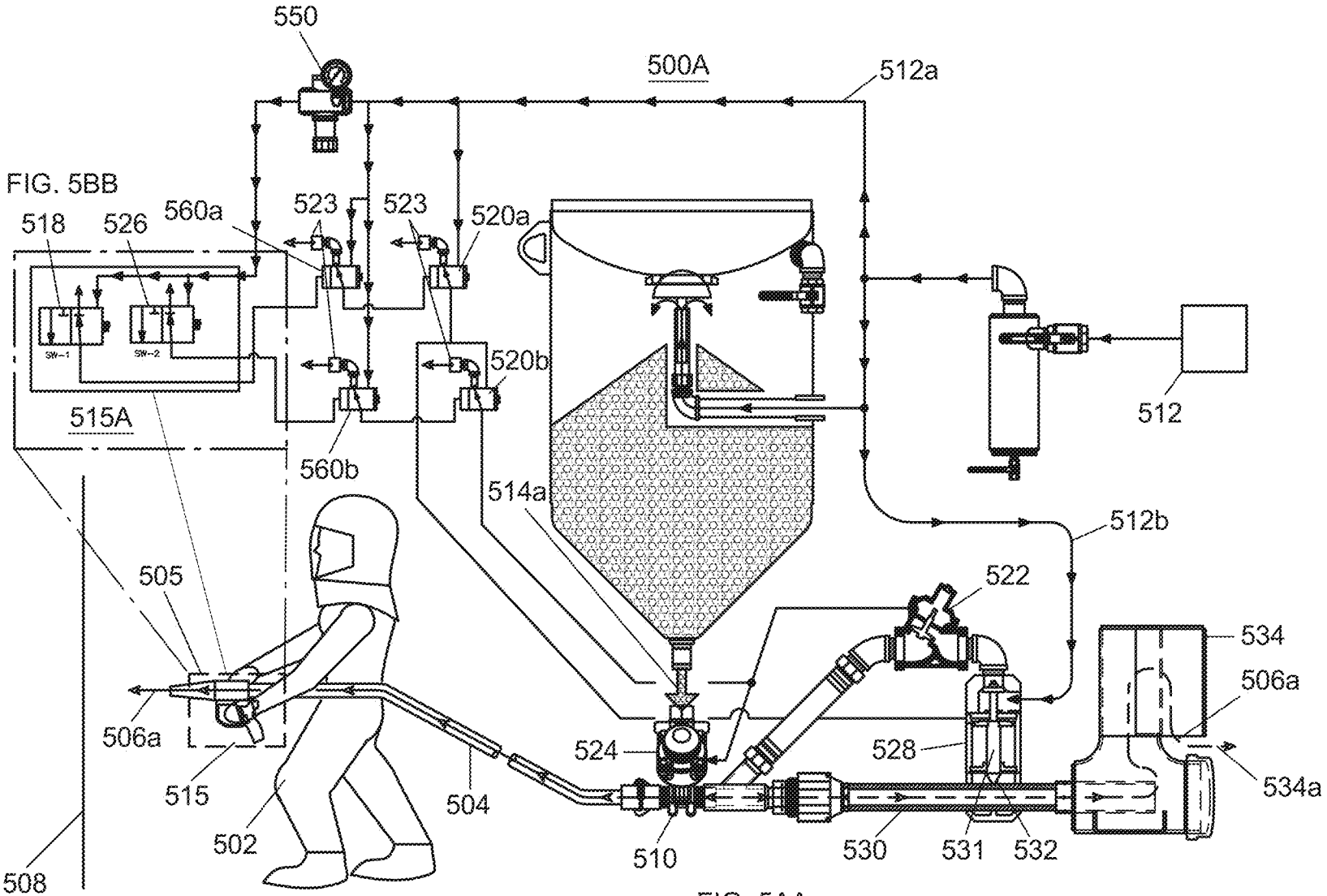
FIG. 5A shows a process diagram view of a pneumatic abrasive blasting system in a no-blast or emergency shutdown mode according to embodiments of the disclosure.
FIG. 5B shows a logic view of a valve assembly configuration for the no-blast or emergency shutdown mode of FIG. 5A according to embodiments of the disclosure.

Referring now to FIGS. 5A, 5B, and 5C together, a process diagram view of a pneumatic abrasive blasting system in a no-blast emergency shutdown mode, a logic view of a valve assembly configuration, and a close-up side cross-sectional view of a deadman assembly, respectively, illustrative of embodiments disclosed herein, are shown.

The previous Figures and accompanying description make reference to embodiments of an abrasive blasting operation that may utilize a multi-position, multi-configuration deadman assembly. While these Figures may depict use an electric-type control configuration, other control mechanisms are possible, such as pneumatic.

To better illustrate to one of skill appreciable differences, FIGS. 5A-5C (with 6A-6C and 7A-7C) provide for a pneumatic operated blast system (and related methods) 500. While it need not be exactly the same, the system 500 may be assembled, run, and operated as described herein and in other embodiments (such as for system 200, and so forth), and as otherwise understood to one of skill in the art.

One apparent difference in functionality is in the case of an electrical circuit being operable when a switch is 'closed'; in contrast, a pneumatic circuit may be operable (i.e., have airflow) when a switch or valve is 'open'. For an analogous explanation, water does not flow from a faucet until the valve in the line is opened via turning a faucet handle.

Components of the system 500 may be arranged by, disposed on, or otherwise coupled together, as otherwise understood to one of skill in the art. Thus, the system 500 may be comparable or identical in some aspects, function, operation, components, etc. as that of other system embodiments disclosed herein (e.g., 200). Similarities may not be discussed for the sake of brevity, but are otherwise adopted herein.

Associated or auxiliary equipment including automation, controllers, piping, hosing, valves, wiring, nozzles, pumps, gearing, tanks, etc. may be shown only in part, or may not be shown or described, as one of skill in the art would have an understanding of coupling the components of the system 500 for operation thereof. All components of the system 500 requiring power or automation may be provided with wiring, tubing, piping, etc. in order to be operable therefore.

As shown here, the blasting system 500 may be in a no-blast emergency shutdown mode or configuration, which normally entails an operator 502 releasing (or otherwise not squeezing/engaging) a deadman assembly 515 (which results in deadman signal devices 518, 526 closing/shutting). The deadman assembly 515 may be associated with a pneumatic flow control 515A shown in FIG. 5B.

The pneumatic deadman assembly 515 may be suited for applications that permit a blast nozzle 505 (or an area proximate thereto) to be held by the operator 502 facing forward during operation, and is particularly suited for environments that prohibit an electrical component or where electric power is not available. As shown here, when a trigger or lever 540 is in an unengaged (or unsqueezed, etc.) or released position (FIG. 5C) a primary deadman signal device 518 and a secondary deadman signal device 526 may be in a closed position. While described as 'closed' here (i.e., the deadman signal devices 518, 526 are closed, and control valves 520 and 521 signal airflow may be vented out of the deadman 515 [such as through an unsealed vent or port—not viewable here]), the crux of FIG. 5B illustrates that a control signal may be withheld or otherwise disabled in a manner that the signal does not communicate past the controllers 520, 521. As such, when the deadman signal devices 518, 526 are closed, respective controllers 520 and 521 prevent an airflow signal 512*a* from transferring airflow from source 512 to respective downstream valves.

Deadman signal devices 518, 526 may be pneumatic trigger deadman cartridges. The deadman signal devices 518, 526 may be configured to send air from the reduced pressure air supply coming from regulator 550 to the pneumatic control valves 520 and 521, respectively. For example, the primary deadman signal device 518 may be configured to send (transfer, etc.) air to the control valve 520 pilot port. 520 then opens and sends a full pressure air signal (before 550) to the combo valve 528 pilot port and the air supply port of 521. The secondary deadman signal device 526 may be configured to send air to the secondary control valve 521 pilot port. The secondary valve 521 may then open and sends a full pressure air signal (before 550) to the air valve 522 pilot port and valve 524 pilot port. Although described here as 'combo' valve, the valve 528 may be a simple shut off valve, such as a ball valve or a pinch valve.

The frame 542 may be configured such that the supply air from the fitting on the outside of the frame 542 may flows through the frame (body) to the deadman signal devices 518 and 526 supply sides, and when engaged by the trigger 540, the control signals from the deadman signal devices 518 and 526 may then flow through the frame 542 to the fittings on the outside of the frame 542, and then to the control valves 520, 521.

Air source 512 may be in fluid communication with multiple flow paths. For example, source 512 may provide control valve air source 512*a*, as well as blast air source 512*b*. Air source 512*a* may communicate with control valve 520. When control valve 520 is activated, the valve 520 may signal the combo valve 528 to open, thereby permitting air flow to blast air valve 522. As shown here, when control valve 520 is deactivated, the signal air to the combo valve 528 and supply air to control valve 521 may be vented 523.

The pneumatic blasting system 500 may use an air pressure regulator 550 to reduce the air pressure (of signal air 512*a*) to the deadman assembly 515. By way of brief comparison, a typical pneumatic deadman control is not regulated. As a result, abrasive air blast equipment control air, including the remote deadman control line is typically at 100-150 psig. Abrasive air blast equipment with a pneumatic remote deadman connect the signal side of the deadman to a pneumatic pilot operated control valve because the deadman valve's flow is too low to quick actuate and deactivate the air and abrasive valves on the equipment.

These pilot operated control valves typically have an activation and a deactivation pressure at the pilot (deadman signal) port. Also, the deactivation pressure is typically lower than activation pressure when applied to the control valve pilot port. This difference may be minor, such as 7-15 psi; however, it could be more or less. While not limited, the pressure differential between the regulated deadman assembly pressure and either or both deactivation pressure settings of the control valves may be set or controlled to be as minimal as possible in order to achieve rapid shutdown response.

In a conventional pneumatic deadman, the response time from release of deadman to deactivation of the pilot operated control valves is known to be excessively unsafe. For example, with deadman signal line pressure at 120 psig, the release time may exceed four seconds or longer. The excess time for deactivation occurs because the deadman signal (unregulated) line pressure to the control valves is at the same pressure as the air source upon release of deadman to shut off blasting. All of the pressure in the line in excess of the deactivation pressure of the control valve must first be vented through the deadman valves in order for the control valve to close (deactivate).

With present embodiments of the disclosure, when the trigger 540 is manually pressed or squeezed to the blast mode (see FIGS. 7A-7C), the deadman signal devices 518, 526 may allow the compressed air 512*a* at the supply port (of the respective deadman signal devices 518, 526) to now flow into the signal port and then to the pilot port of the respective control valves 520, 521. This pressure may be determined by the regulator 550. So, for example, the pressure in the line between the deadman 515 and the control valves 520, 521 may be a reduced, regulated pressure of about 70 psig (as compared to source 512, which may be in excess of 120 psig).

The control valves 520, 521 may then activate when sufficient pressure is generated at the pilot port and allows compressed air 512*a* to actuate the abrasive, air, and quick exhaust (combo) valves 524, 522, and 528, respectively.

When the deadman 515 is manually released to the position shown in FIG. 5C, the deadman supply port is shut off and the deadman signal or pilot port is vented to atmospheric through the remote deadman signal devices 518, 526 until the pressure drops below the control valve deactivation pressure at the pilot port. The control valve(s) 520, 521 may then shut off air pressure and vent the signal line of the abrasive, air, and exhaust valve to atmospheric through vents 523.

With the air pressure regulator 550 upstream of the deadman 515 supply line, embodiments herein provide for the ability to reduce the deadman pressure to facilitate valve deactivation OFF response time to about two seconds or less by reducing this pressure differential. In embodiments the pressure differential between the deadman assembly 515 and either of the control valves 520, 521 may be about 1 psi above respective activation pressure to about 95 psi above deactivation pressure. In other embodiments, the pressure differential may be in the range of about 1 psi to about 40 psi. In still other embodiments, the pressure differential between the deadman assembly 515 and the respective deactivation pressure setting may be in the range of about 10 psi to about 15 psi.

When the deadman 515 is released, the air may vent through the deadman 515 until the air pressure control valve signal force is lower than the return spring force. The spring may then close the port and the air signal to the air, combo and abrasive valves is vented closing the valves.

In some embodiments, it may be desirous to exceed minimum activation pressure to create a functional buffer to assure ample pressure to activate the control valves because the activation pressure could increase with wear and accumulation of contamination from normal use.

As a working example, by regulating the pressure in deadman supply line down to 75-80 psi and increasing the spool spring tension to increase the spool shift pressure to 55-60 psi, the differential pressure between the deadman supply line and control valve is reduced from about 80 psi to 20 psi. This reduces the time for control valve deactivation considerably. Higher pressure, at the same 20 psi pressure differential between deadman supply line and control valve, will result in faster control valve deactivation time.

In embodiments, the elapse of time between deadman release and control valve deactivation may be less than 2 seconds. In other embodiments, the elapse of time is in a range of about 0.1 seconds to no more than 2 seconds.

In this respect, the primary controller 520 may prevent airflow 512*a* from transferring to combination valve 528. As shown here, a ram 531 may be in a normally open position when airflow 512*a* is withheld from the valve 528. At the same time, valve end 531*a* may be closed, therefore preventing blast air 512*b* to flow to the air valve 522.

In an analogous manner the secondary controller 521 may prevent airflow 512*a* from transferring to blast air valve 522 through control valve 520. As shown here, the blast air valve 522 and the media control (metering) valve 524 may be in a normally closed position, whereby blast air 512*b* and (dry) media 514*a* are prevented from entering mixing zone or region 510.

In the event the deadman assembly 515 was previously engaged, but then released, there may be residual flow 506*a* within the blast line 504. However, as the exhaust line 530 may be unpinched, residual flow 506*a* may exit an outlet 534*a* of a muffler 534. The exhaust line 530, muffler 534, and outlet 534*a* may be sized and otherwise configured to promote rapid dissipation therethrough of any residual flow 506*a*.

A close-up view of the deadman assembly 515 in the no-blast emergency shutoff configuration may be seen in FIG. 5C, which illustrates primary and secondary deadman signal devices 518 and 526 in a closed or airflow-off positions. The operation of the assembly 515 may be like that as otherwise described herein, and reference may be made to, for example, FIG. 5C for an understanding of the operation of the trigger 540, lock flap 548, etc.

The deadman signal devices 518, 526 may be coupled with the logic flow (515A-C) and respective controllers via wiring, lines, infrared, or other suitable signal transmission configuration. As shown here, wiring (for air feed) 519 may be disposed within a cavity 543. The air feed may be coupled with the deadman supply line via couplers, fittings, nipples, etc.

In embodiments, there may be a deadman/hose configuration that may include one hose used for the supply air and one for the signal. In this way, the deadman assembly 515 may be a 3-position, 2-function pneumatic deadman configured in operable communication with a multi-hose configuration, such as a "tripleline"—a hose configured to accommodate two signals sent to an abrasive blast unit, one for each control valve, plus the supply hose.

In aspects, there may be an airline configured in a manner to connect to fittings within the deadman 515 configured to communicate with signal devices 518, 526. An opposite, respective end(s) of the airline may be configured to couple with the regulator 550 and valves 520, 521.

Referring briefly to FIGS. 5AA and 5BB together, a process diagram view of a pneumatic abrasive blasting system having an alternative valve configuration, and a logic view of the valve assembly configuration for the system of FIG. 5AA, respectively, illustrative of embodiments disclosed herein, are shown.

FIG. 5AA illustrates embodiments of an abrasive blasting operation that may utilize a multi-position, multi-configuration deadman assembly as described herein. While this Figure may depict use a pneumatic-type control configuration, other control mechanisms are possible, such as electrical.

While it need not be exactly the same, the system 500A may be assembled, run, and operated as described herein and in other embodiments (such as for system 200, 500 and so forth), and as otherwise understood to one of skill in the art.

Components of the system 500A may be arranged by, disposed on, or otherwise coupled together, as otherwise understood to one of skill in the art in view of teachings herein. Thus, the system 500A may be comparable or identical in some aspects, function, operation, components, etc. as that of other system embodiments disclosed herein (e.g., 200, 500, etc.), and identical reference numbers may be used. Similarities may not be discussed for the sake of brevity, but are otherwise adopted herein.

As discernable, embodiments herein provide for a pneumatic system that may utilize a first and second control valves (sometimes primary and secondary, respectively) 520*a* and 520*b* that may be of the same type of control valve.

The first and second control valves 520*a* and 520*b* may be configured in a manner whereby a control signal may be withheld or otherwise disabled in a manner that the signal does not communicate past the valves. As such, when deadman signal devices 518, 526 are closed, respective control valves 520*a* and 520*b* may prevent an airflow signal 512*a* from transferring airflow from source 512 to respective downstream valves.

Deadman signal devices 518, 526 may be pneumatic trigger deadman cartridges. The deadman signal devices 518, 526 may be configured to send air from the reduced pressure air supply coming from regulator 550 to the pneumatic control valves 520*a* and 520*b*, respectively.

One or both of the control valves 520*a* and 520*b* may have an imbalanced configuration. In this respect, the valves 520*a* and/or 520*b* may provide a quick OFF response. 'Imbalanced' in this regard may refer to the system 500A configuration that utilizes the supplied compressed air to add to the shifting force in a designated direction. Put another way, the 'imbalance' refers to the notion that the opening and closing of valves 520*a*, 520*b* may be dependent upon the supply pressure, as the valves 520*a*, 520*b* may have an internal mechanism (i.e., spool) movable based on the amount of supplied air pressure.

To facilitate quick response of the pilot port activation and deactivation pressure of control valves 520*a*, 520*b*, the system 5AA may utilize additional signal supply control valves 560*a* and 560*b* in communication with respective controllers 520*a* and 520*b*. The additional control valves 560*a* and 560*b* may have a 'balanced' system configuration.

Control valves 560*a* and 560*b* may function as a pseudo-signal booster, such as by taking the regulated pressure signal from the deadman 515, needed for quicker deadman valve cartridge venting during deactivation, and delivering a full pressure signal to control valves 520*a* and 520*b*. This may facilitate a greater lower range of deadman regulated pressures. Without the control valves 560*a* and 560*b*, valves 520*a* and 520*b* may not activate under unregulated high air supply pressures and low regulated deadman pressure.

In this respect, the shifting forces of the valves 560*a*, 560*b* may be symmetrical, and independent of any supplied air. As a result, the activation and deactivation pressures of the valves 560*a*, 560*b* need not be varied. Either or both of the valves 560*a*, 560*b* may have a respective internal movable mechanism (e.g., spool) configured to open or close the valve regardless of any supplied air pressure.

As a working example, the controllers 560*a*, 560*b* may (always) open at 34-35 psi signal pressure, and (always) close at 15-16 psi signal pressure. In the event of a stiffer internal spring-bias on the respective internal movable mechanism, the opening pressure may be at about 40-45 psi, and the closing pressure may be at about 32-34 psi. Whatever the case may be in terms of supplied air, the valves 560*a*, 560*b* may consistently open and close at certain pressure as long as the signal pressure sent to the valves 560*a*, 560*b* is above the activation pressure.

Using a smaller balanced control valve 560*a*, 560*b* to control the controllers 520*a*, 520*b* may provide the benefits of both designs, quick response at all typical pressure ranges.

In addition, the deadman line pressure may be regulated in a range of about 45-75 psi, which would be advantageous for just about any abrasive air blast application.

Figures 6A, 6B, 6C:
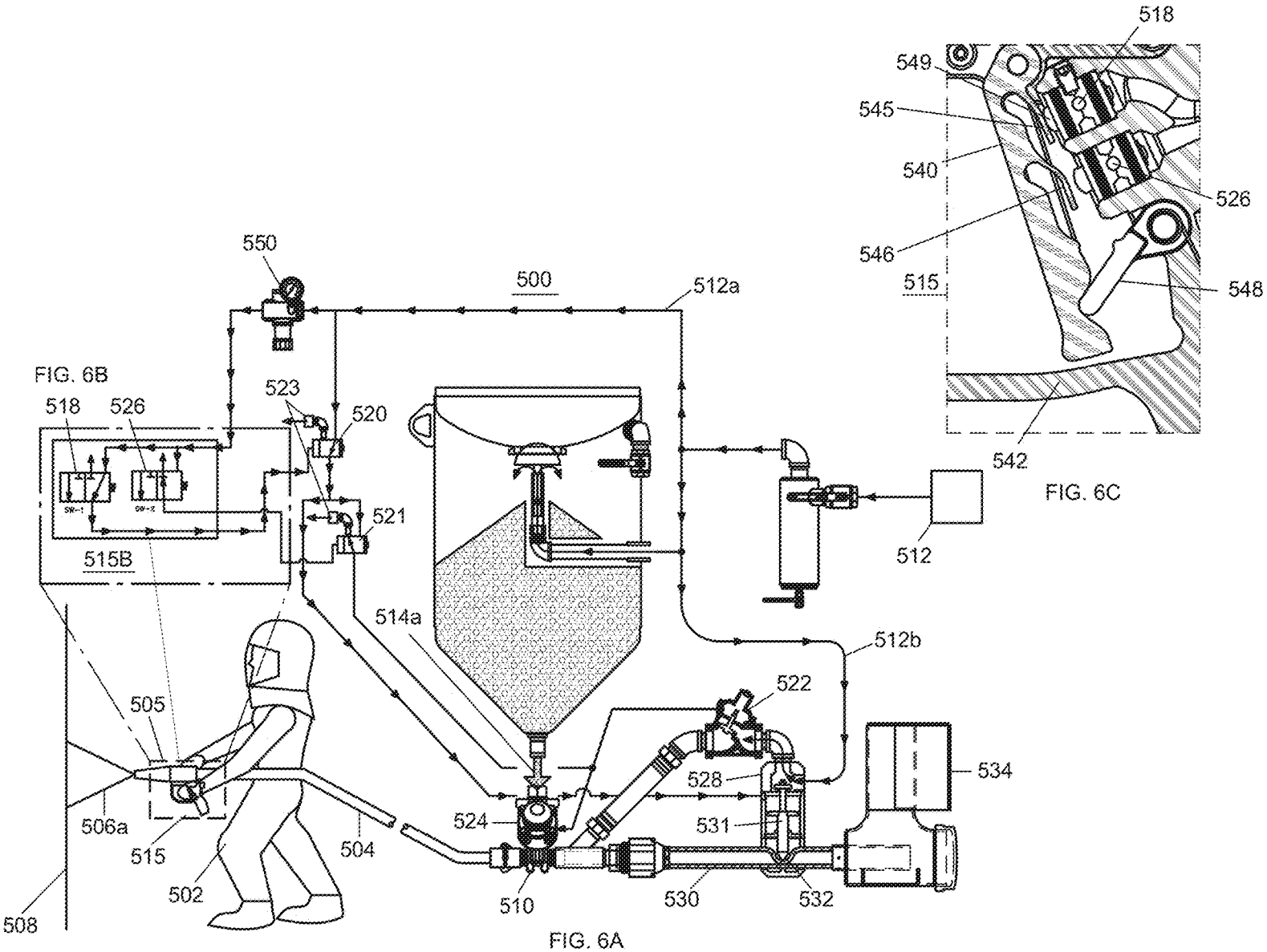
FIG. 6A shows a process diagram view of a pneumatic abrasive blasting system in a no-blast, nozzle-vent mode according to embodiments of the disclosure.
FIG. 6B shows a logic view of a valve assembly configuration for the no-blast, nozzle-vent mode of FIG. 6A according to embodiments of the disclosure.
FIG. 6C shows a close-up side cross-sectional view of a deadman assembly for the no-blast, nozzle-vent mode of FIG. 6A according to embodiments of the disclosure.

Referring now to FIGS. 6A, 6B, and 6C together, a process diagram view of a pneumatic abrasive blasting system in a no-blast, nozzle-vent mode, a logic view of a switch assembly configuration, and a close-up side cross-sectional view of a deadman assembly, respectively, illustrative of embodiments disclosed herein, are shown.

FIGS. 6A-6C illustrate the abrasive blasting system 500 for use in treating the surface 508 moved to a no-blast, nozzle-vent mode (or sometimes non-emergency). As shown here, this mode normally entails an operator 502 partially releasing the deadman assembly 515 in a manner whereby the trigger/lever 540 may yet energize the primary valve 518, but is prohibited from doing the same for the secondary signal device 526. This results in logic configuration 515B.

As the controller 520 may now be open, airflow 512*a* may be transferred to the combo valve 528 in sufficient enough manner to move (urge) the ram 531 ram against the exhaust line 530 at pinch point 532, thereby 'closing' off the line 530.

Only when the operator 502 manually toggles a lock flap 548 out of the way of the handle 540 will the operator 502 be able to fully squeeze the handle 540 in order to engage/close valve 526. Otherwise, as shown here in FIG. 6C, the lock flap 548, while no longer in the first position (FIG. 5C), may be configured to prohibit the movement of the handle 540 in order to engage the secondary deadman signal device 526 (but yet able to engage the primary deadman signal device 518).

For example, an end 548*a* of the lock flap 548, by being moved into recess 547, may be engaged with and prevent movement of the handle 540 from the position shown in FIG. 6C in order to initiate the blast mode (7C).

Referring now to FIGS. 7A, 7B, and 7C together, a process diagram view of a pneumatic abrasive blasting system in a blast mode, a logic view of a switch assembly configuration, and a close-up side cross-sectional view of a deadman assembly, respectively, illustrative of embodiments disclosed herein, are shown.

FIGS. 7A-7C illustrate the abrasive blasting system 500 for use in treating the surface 508 moved to a blast mode. As shown here, this mode normally entails an operator 502 fully engaging the deadman assembly 515 in a manner whereby the trigger/lever 540 may energize each of the primary deadman signal device 518 and the secondary deadman signal device 526, as indicated by depressed switch arrows B. This may only occur then the operator 502 manually moves an end 548*a* of lock flap 548 out of the way (whereby the end 548*a* may be moved further out of or beyond recess 547). When the deadman signal devices 518 and 526 are engaged, the system 500 may have the logic configuration 515C.

The closing of the secondary deadman signal device 526 results in activation of the secondary controller 521 in manner whereby signal airflow 512*a* may now transfer to the air valve 522 and the metering valve 524. Once the air valve 522 opens, blast air 512*b* may flow through the valve 522 toward mixer 510. In a similar manner, once the metering valve 524 opens, media 514*a* may transfer from media storage 514, through the valve 524, and into mixer 510.

As the vent line 530 remains closed (pinched) [via primary deadman signal device 518 engaged and primary controller 520 transferring signal air to combo valve 528], the only path for the mixed air and media 506 is through hose 504 and out of the nozzle 505. The blast media 506 impacts against the surface 508 to accomplish the desired blasting outcome.

Figure 8:
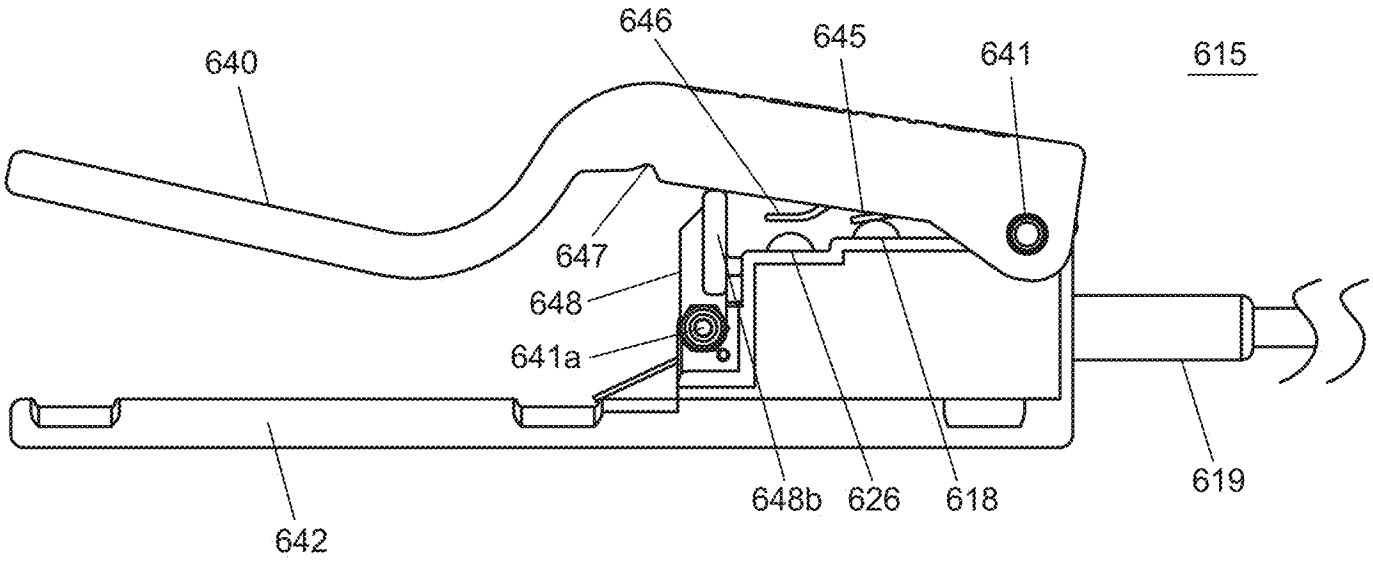
FIG. 8 shows a longitudinal side view of a deadman assembly according to embodiments of the disclosure.

Referring now to FIG. 8 a longitudinal side view of a deadman assembly, illustrative of embodiments disclosed herein, is shown. FIG. 8 shows by way of example a non-limiting embodiment of a deadman assembly 615 suitable for use with blasting methods and systems of the present disclosure, or for adding to new blasting systems or retrofitting to existing.

The deadman assembly 615 may be associated with switch logic (e.g., 215A, 215B, 215C, etc.) described herein, and thus may have a multi-position, multi-function configuration. The deadman assembly 615 may be in operable communication with a power source (not shown here) via wiring 619. The power source may be electrical, pneumatic, and so forth.

The deadman assembly 615 may be suited for applications that permit a blast nozzle to be held by an operator facing forward during operation. As shown here, when a trigger or lever 640 is in an unengaged (or unsqueezed, etc.) or released position (FIG. 2C) a primary deadman signal device 618 and a secondary deadman signal device 626 may be in an open or signal-stopped position. Deadman signal devices 618, 626 may be biased open or closed; whatever the case may be, when a lock flap 648 is in its shown first position, an activation signal may not be transmitted further downstream (such as to a valve).

The lock flap 648 may be biased to the first position, such as by a spring. The lock flap 648 may be movingly (such as pivotably) coupled with a frame 642 of the deadman assembly 615 at coupling point 641*a*. Although not shown here, when an operator (e.g., 202) desires to engage in a blast mode, the operator may use a finger to push pad 648*b*, thereby moving a flap end 648*a* out of blocking engagement of a trigger lever 640.

The trigger lever 640 may be movingly (such as pivotably) coupled with the frame 642 at coupling point 641. In the event the lock flap 648 resides in recess 647, the operator will be unable to move the trigger lever 640 enough to engage cantilever tab 646 with secondary signal control 626. As such, in this second lock flap position, only cantilever tab 645 may engage the respective signal control 618.

To engage or return to blasting, the operator must further move the lock flap 648 out of the recess 647 to a third or blast flap position. At this point, both deadman signal devices 618, 626 may be activated in manner whereby downstream signal transmission may occur (such as to a metering valve, air valve, and/or combo vent valve).

Referring now to FIGS. 9A, 9B, 9C, and 9D together, a close-up side cross-sectional view of an electrical deadman assembly in a no-blast or emergency shutdown mode having a biased trigger mechanism, a close-up side cross-sectional view of the deadman assembly moved to a no-blast, nozzle-vent mode, a close-up side cross-sectional view of the deadman assembly moved to a blast mode, and a rearward view of a trigger handle, respectively, illustrative of embodiments disclosed herein, are shown.

Although shown here as an electrical configuration, embodiments herein are not meant to be limited, and other power configurations for the deadman assembly 915 are possible, such as pneumatic, hydraulic, and so forth. One of skill would appreciate the embodiments of FIGS. 9A-9D are applicable to all embodiments of the disclosure, such as the multi-mode configuration description of FIGS. 2A-2C/3A-3C/4A-4C.

Figure 9C:
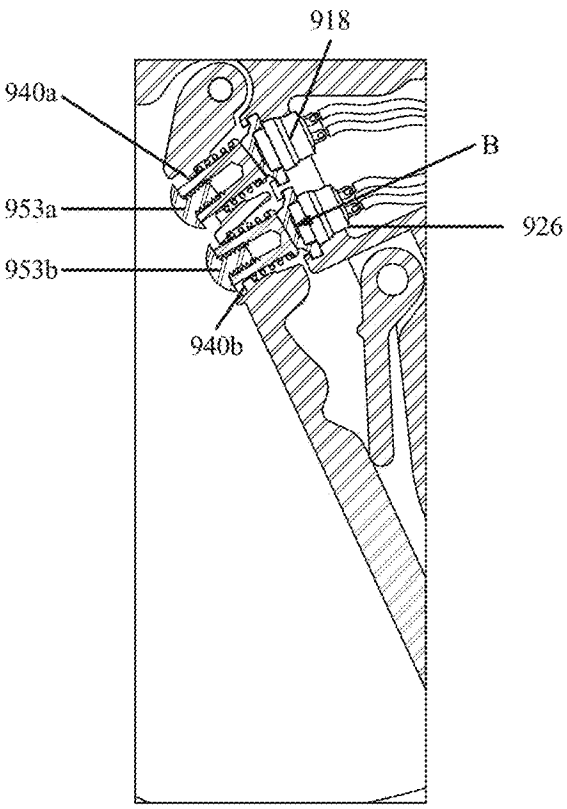
FIG. 9C shows a close-up side cross-sectional view of a deadman assembly of FIG. 9A moved to a blast mode according to embodiments of the disclosure.
Figure 9B:
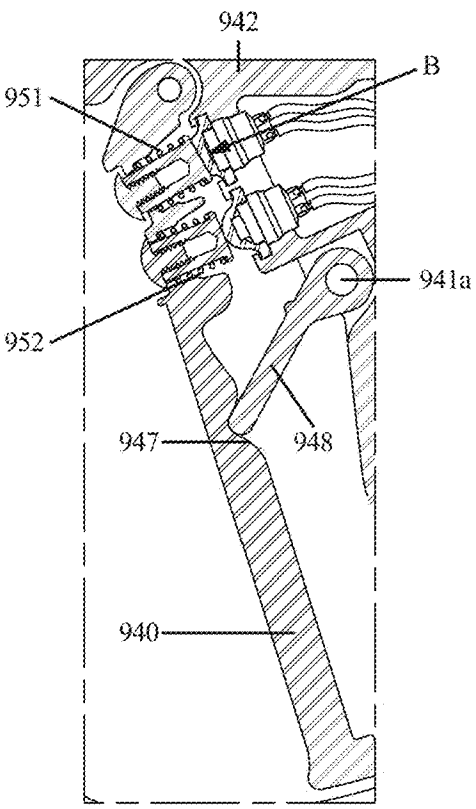
FIG. 9B shows a close-up side cross-sectional view of the deadman assembly of FIG. 9A moved to a no-blast, nozzle-vent mode according to embodiments of the disclosure
Figure 9A:
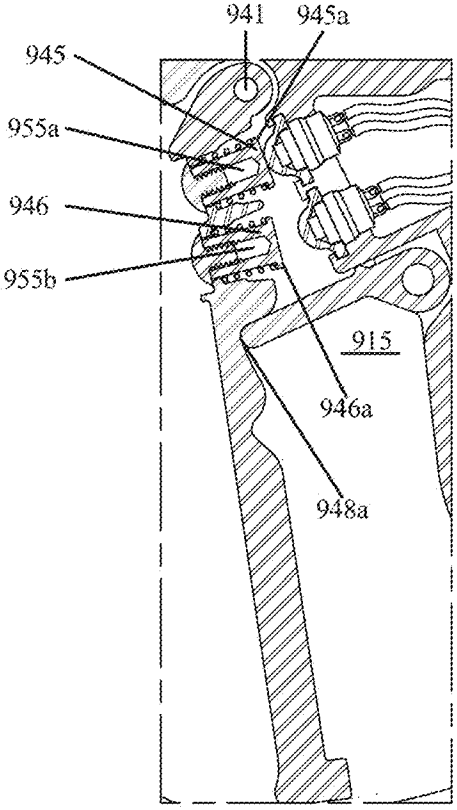
FIG. 9A shows a close-up side cross-sectional view of an electrical deadman assembly in a no-blast or emergency shutdown mode having a spring-biased trigger mechanism according to embodiments of the disclosure.

FIGS. 9A-9C illustrate a deadman assembly 915 for use with an abrasive blasting system (such as any system described herein). The assembly 915 may be multi-position, multi-function. For example, the deadman 915 may have a no-blast or emergency shutdown mode (or position, configuration, etc.), which normally entails an operator releasing (or otherwise not squeezing/engaging) a trigger or lever 940 of the deadman assembly 915 (i.e., FIG. 9A).

As shown in FIG. 9A, when the trigger or lever 940 is in an unengaged (or unsqueezed, etc.) or released position a primary deadman signal device 918 and a secondary deadman signal device 926 may be in a corresponding open or unengaged position. In embodiments, one or both of the primary deadman signal device 918 and the secondary deadman signal device 926 may have a normally open configuration that prevents transfer of a signal to associated system controllers.

The trigger 940 may be movingly (such as pivotably) coupled with the frame 942, such as at pivot point 941. The trigger 940 may be biased away from engaging the deadman signal devices 918, 926, such that an amount of squeezing force may be needed in order to move the trigger 940.

Any initial attempt to squeeze the trigger 940 may be impeded by coming into contact with an end 948*a* of a lock flap 948. The lock flap 948 may be movingly (such as pivotably) coupled with the frame 942, such as at pivot point 941*a*. The lock flap 948 may have a first position. The first position of the lock flap 948 may prevent the trigger (or respective plungers 945, 946) from engaging (closing) the deadman signal devices 918, 926. The lock flap 948 may be biased (such as with a spring) to the first position.

The deadman signal devices 918, 926 may be coupled with any logic circuit of embodiments herein and respective controllers via wiring, lines, infrared, or other suitable signal transmission configuration.

FIG. 9B shows a partially released/squeezed (or intermediate, second, etc.) position whereby the trigger/lever 940 may energize the primary signal device 918, but is prohibited from doing the same for the secondary signal device 926. This position may constitute a non-emergency release (e.g., a shift from the blast mode to a non-emergency [partial] release of the deadman assembly 915).

As shown, the lock flap 948 may be toggled and moved into the recess 947. This position may facilitate the first plunger 945 to engage and close primary signal device 918. At the same time, the lock flap 948, while no longer in the first position (FIG. 9A) or third position (FIG. 9C), may be configured to prohibit the movement of the handle 940 in order to engage the secondary deadman signal device 926 (but yet able to engage the primary signal device 918). Accordingly, the deadman 915 (or lock flap 948) may have an intermediate or second position that allows the trigger to engage primary deadman signal device 918, but not engage the secondary deadman signal device 926.

The only way to initiate blast mode of FIG. 9C is to (manually) move the lock flap 948 out of the way (via pivot connection point 941*a*), which means further moving the end 948*a* out of (or further beyond) the recess 947. Only then may the handle 940 now freely move (via pivot connection point 941) toward the deadman signal device 926. But unless and until this action occurs, or the trigger 940 is released, the deadman assembly 915 may remain in the no-blast, nozzle-vent mode or otherwise out of blast mode.

Figure 9D:
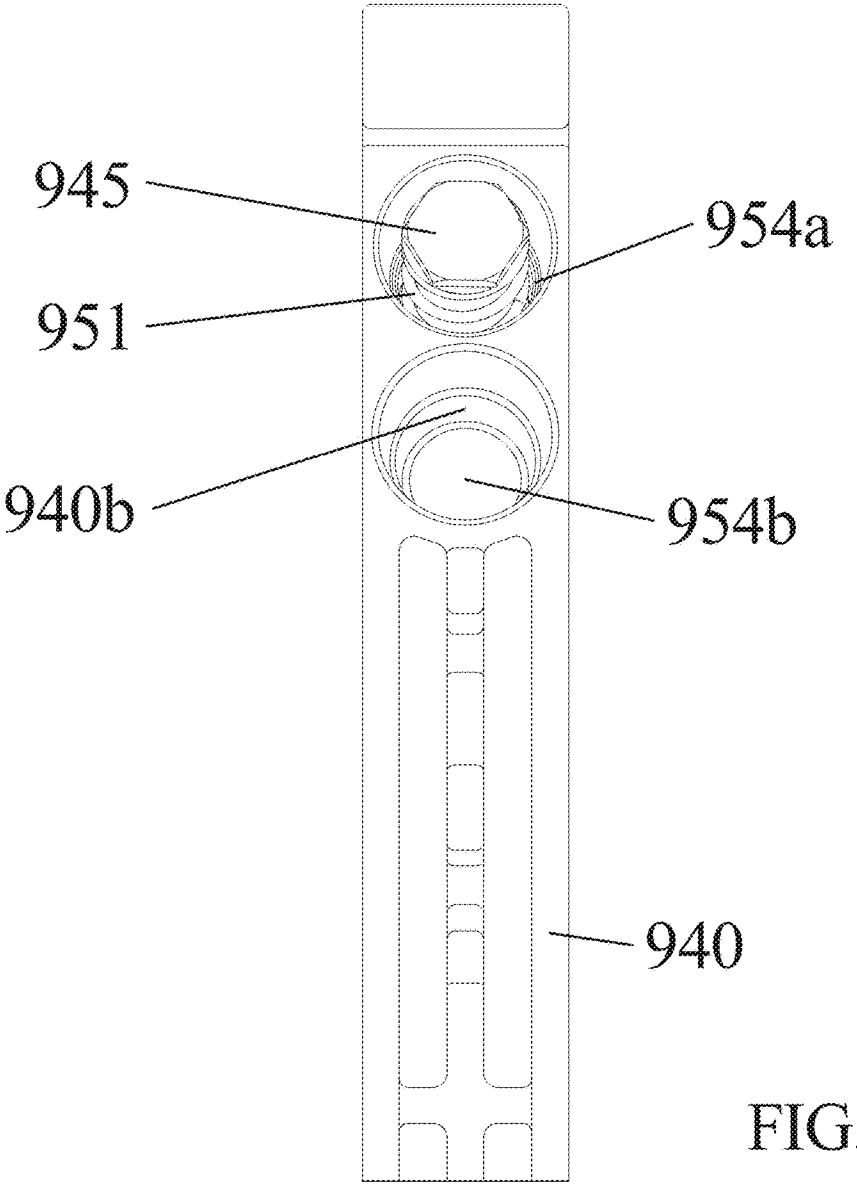
FIG. 9D shows rearward view of a trigger according to embodiments of the disclosure.

The trigger handle 940 may be configured with a first plunger cavity 954*a* (FIG. 9D). There may be a second plunger cavity 954*b*. The plunger cavity 954*a* and 954*b* may be generally hollow with suitable shape to house respective movable plungers 945 and 946. The plungers 945, 946 may be movable via engagement with a respective biased member 951, 952. The bias member 951, 952 may be, for example, a spring.

The first biased member 951 may be configured to facilitate the first movable plunger 945 engaging primary deadman signal device 918. That is, the first biased member 951 may (indirectly or directly) activate the primary deadman signal device 918, but not add signification force when it is compressed to activate the secondary deadman signal device 926 that it make holding that force difficult for the operator.

In aspects, the trigger member 940 may be configured for a range of motion while the primary signal device 918 is held in a signal flow position. In other aspects, the trigger member 940 may be movable in range of motion while a first plunger 945 is engaged with the primary signal device 918, and the primary signal device 918 is in a signal flow position. In yet other aspects, the first bias member may be configured to facilitate a range of motion of the trigger member while a first plunger 951 may be engaged with the primary signal device 918, and the primary signal device 918 may be in a signal flow position. The bias members 951 and/or 952 may be a spring suitable to expand and contract in a desired manner.

While not limited, the plungers 945, 946 may be a cylindrical shaped body, whereby the bias member 951, 952 may be disposed therearound. The bias member 951 may be held between an end plunger lip 945*a* and a first cavity lip 940*a*. The freedom of movement of the plunger 945 may be limited by a first end cap 953*a* coupled therewith. The end cap 953*a* may be, for example, threadingly engaged into a first hollow 955*a* of the plunger 945. The bias member 951 may be configured to facilitate depressing of the primary deadman signal device 918 to a closed device position B as the trigger handle 940 is moved from the first position. As such, as the deadman signal device 918 comes into contact with the plunger 945, the bias member 951 may provide enough resistive force to eventually allow the plunger 945 to move the deadman signal device 918 to the closed position B.

In an analogous manner, the bias member 952 may be held between an other end plunger lip 946*a* and a second cavity lip 940*b*. The freedom of movement of the second plunger 946 may be limited by a second end cap 953*b* coupled therewith. The end cap 953*b* may be, for example, threadingly engaged into a respective hollow 955*b* of the second plunger 946. The bias member 952 may be configured to facilitate depressing of the secondary deadman signal device 926 to a closed signal device position B as the trigger handle 940 is moved from the second position (FIG. 9B) to a third or blast position (FIG. 9C). As such, as the secondary deadman signal device 926 comes into contact with the plunger 946, the bias member 952 may provide enough resistive force to eventually allow the plunger 946 to move the secondary deadman signal device 926 to its respective closed position B.

Figure 10C:
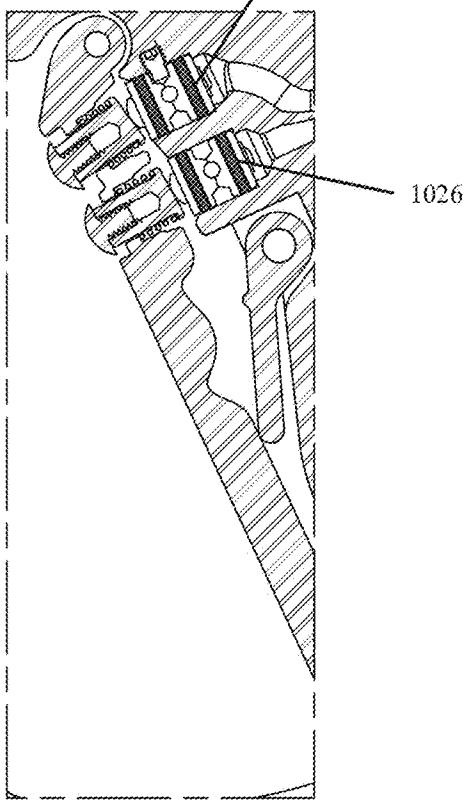
FIG. 10C shows a close-up side cross-sectional view of a deadman assembly of FIG. 10A moved to a blast mode according to embodiments of the disclosure.
Figure 10B:
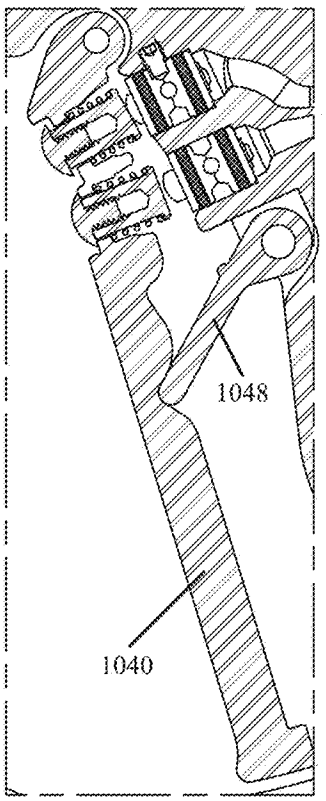
FIG. 10B shows a close-up side cross-sectional view of the deadman assembly of FIG. 10A moved to a no-blast, nozzle-vent mode according to embodiments of the disclosure.
Figure 10A:
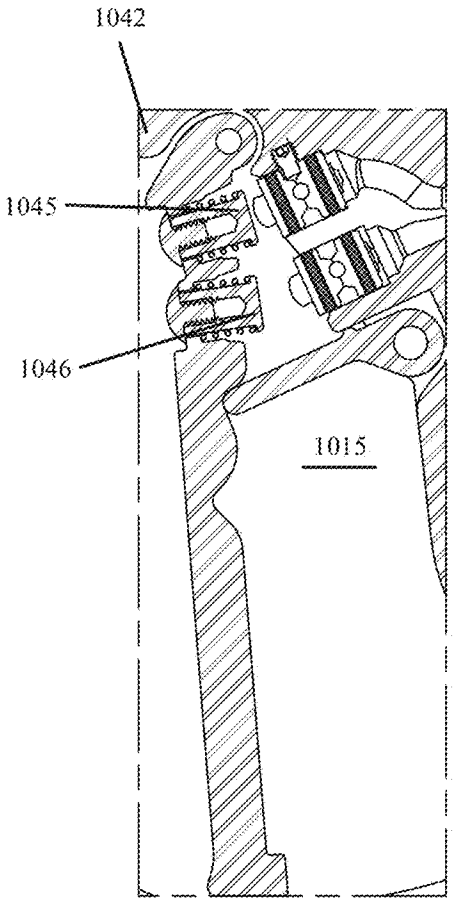
FIG. 10A shows a close-up side cross-sectional view of a pneumatic deadman assembly in a no-blast or emergency shutdown mode having a spring-biased trigger mechanism according to embodiments of the disclosure.

Referring briefly to FIGS. 10A, 10B, and 10C together, a close-up side cross-sectional view of a pneumatic deadman assembly in a no-blast or emergency shutdown mode having a biased trigger mechanism, a close-up side cross-sectional view of the deadman assembly moved to a no-blast, nozzle-vent mode, and a close-up side cross-sectional view of the deadman assembly moved to a blast mode, respectively, illustrative of embodiments disclosed herein, are shown.

FIGS. 10A-10C illustrate a deadman assembly 1015 for use with an abrasive blasting system (such as any system described herein) that may be multi-position, multi-function (akin to 915, etc.).

One of skill would readily appreciate similarities of the deadman assembly 1015 to other embodiments described herein, and for the sake of brevity, only a brief description is provided. As seen, the deadman assembly may utilize a primary deadman signal device 1018 and a secondary deadman signal device 1026. In order to actuate either or both of the deadman signal devices 1018, 1026, a respective plunger 1045 and 1046 must be moved into contact therewith.

A trigger 1040 may be movingly (such as pivotably) coupled with the frame 1042. The trigger 1040 may be biased away from engaging the deadman signal devices

1018, 1026, such that an amount of squeezing force may be needed in order to move the trigger 1040.

Any initial attempt to squeeze the trigger 1040 may be impeded by coming into contact with a lock flap 1048. The lock flap 1048 may be movingly (such as pivotably) coupled with the frame 1042. The lock flap 1048 may have a first position (FIG. 10A), a second position (FIG. 10B), and a third position (FIG. 10C), each corresponding a mode of operation.

Figure 11A:
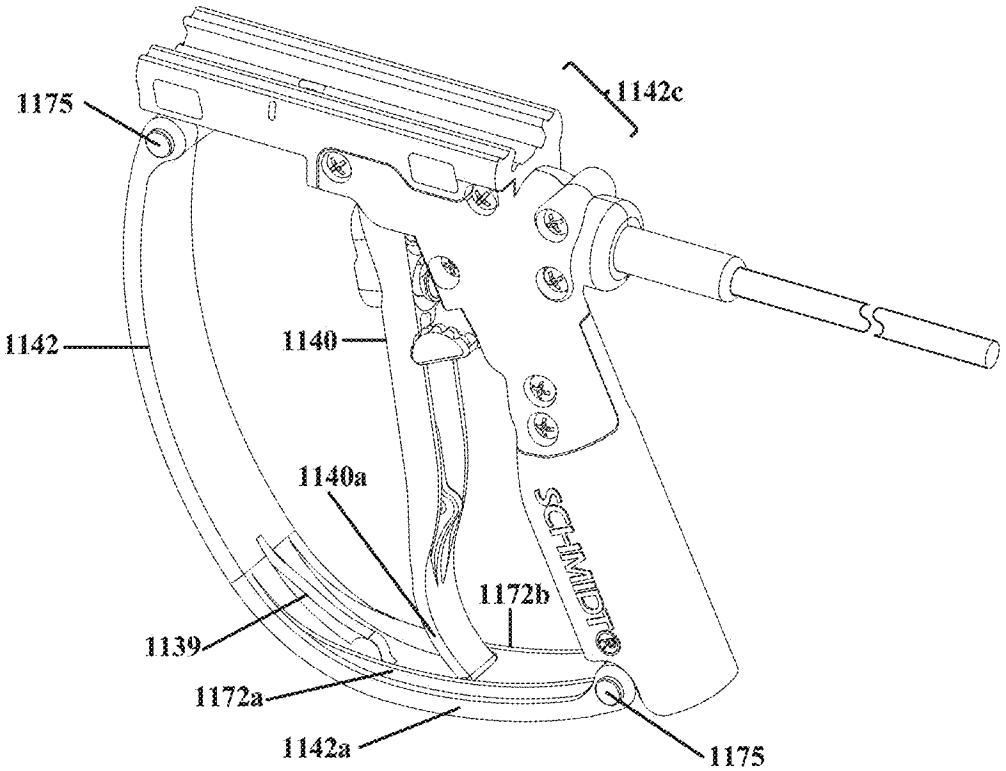
FIG. 11A shows a partial isometric view of an alternate frame for a deadman assembly according to embodiments of the disclosure.
Figure 11:
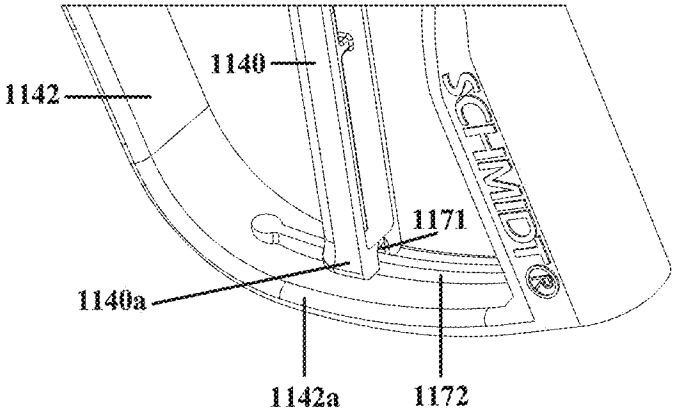
FIG. 11 shows a partial isometric view of a frame for a deadman assembly according to embodiments of the disclosure.

Referring now to FIG. 11, a partial isometric view of a frame for a deadman assembly, illustrative of embodiments disclosed herein, is shown. FIG. 11 shows a frame 1142 for use with a deadman assembly (e.g., 215, 915, etc.). The frame 1142 may have a trigger 1140 movably coupled therewith. In order to provide stability to the trigger 1140, a lower portion 1142*a* of the frame 1142 may be configured with a stabilization or guide ridge 1172. The stabilization ridge 1172 may be configured to engage or interact with a trigger rail 1171. The trigger rail 1171 may be formed or otherwise disposed in a bottom trigger portion 1140*a* of the trigger 1140.

Referring now to FIG. 11A, a partial isometric view of an alternate frame for a deadman assembly, illustrative of embodiments disclosed herein, is shown. FIG. 11A shows alternative deadman frame/trigger configuration comparable to that in nature of the assembly shown in FIG. 11, and may be used with any deadman assembly (e.g., 215, 915, etc.).

The deadman may have a frame (or guard) 1142 with a trigger 1140 movably coupled therewith. In order to provide stability to the trigger 1140, there may be one or more side guard rails 1172*a*, 1172*b* formed on a lower portion 1142*a* of the frame 1142. Although not viewable in detail here, a trigger lower end 1140*a* may have one or more side protrusions that extend outwardly (e.g., laterally) in order to engage a protrusion receptacle of the respective guard rails 1172*a*, 1172*b*.

The lower portion 1142*a* may also have a stabilization ridge or stop 1139, which may be configured to engage or interact with the lower trigger end 1140*a* in order to prevent too much movement. Of noticeable difference to the view shown in FIG. 11, FIG. 11A shows the trigger 1140 may have curvature. The curvature may be present in the lower end 1140*a* proximate to where it comes into (near) contact with the frame 1142. It has been discovered that the curvature may provide an added amount of flexibility to the trigger 1140 in the event the deadman is dropped. The bending moment may prevent breaking the trigger 1140.

FIG. 11A further illustrates the frame 1142 may be akin to a guard-type structure configured for coupling with a rail/handle portion 1142*c*. For example, the frame 1142 may be coupled to the portion 1142*c* via one or more pins (or the like) 1175.

In this way, the frame 1142 may flex and/or pivot at the pins 1175. This movement may allow the frame 1142 to flex and pivot on the pins 1175 on each end thereof. The ability of the frame 1142 and the portion 1142*c* to flex at the pins 1175 may allow the frame 1142 to flex or deflect without breaking.

Figure 11C:
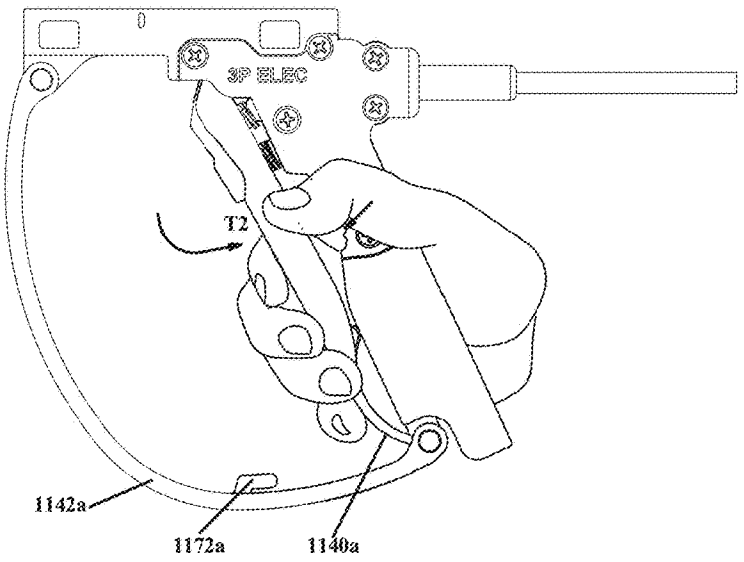
FIG. 11C shows a partial side view of the frame of FIG. 11B according to embodiments of the disclosure.
Figure 11B:
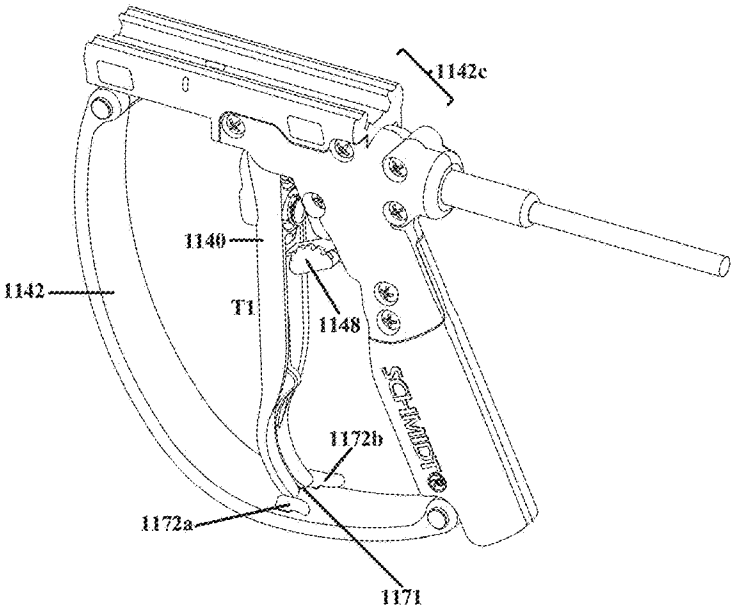
FIG. 11B shows a partial isometric view of another frame for a deadman assembly according to embodiments of the disclosure.

Next referring to FIGS. 11B and 11C, a partial isometric view and a side view of another frame for a deadman assembly, respectively, illustrative of embodiments disclosed herein, are shown. FIGS. 11B and 11C show together another embodiment of deadman frame/trigger configuration comparable to that in nature of the assembly shown in FIG. 11/11A, and may be used with any deadman assembly (e.g., 215, 915, etc.).

Analogous to other embodiments, the deadman may have a frame (or guard) 1142 with a trigger 1140 movably coupled therewith. In order to provide stability to the trigger 1140, there may be one or more side guard rails 1172*a*, 1172*b* formed on a lower portion 1142*a* of the frame 1142.

Of significance here, the side guard rails 1172*a*, 1172*b* need not engage the trigger 1140 at all times. For example, when the trigger 1140 is in a first trigger position T1, the lower portion 1140*a* may engage the side rails 1172*a*, 1172*b*. However, when the trigger 1140 is moved or squeezed, such as to a second trigger position T2, the lower portion 1140*a* may move out of engagement with the side rails 1172*a*, 1172*b*. This configuration may provide (uniform) strength along the frame 1142 by using the rails 1172*a*, 1172*b* for only the time when the trigger 1140 is an off or un-squeezed position (T1). 'Uniform' strength may refer to the trait where deflection or bending may be dissipated over the frame/guard 1142 equally.

The first trigger position T1 may coincide with a position of a lock flap 1148. For example, when the lock flap 1148 is in a first lock flap position, the trigger 1140 may be in the first trigger position T1. Or, when the lock flap 1148 is moved out of the first position, such as to a second position, third position, etc., the trigger 1140 may be in the second trigger position T2, such as shown in FIG. 11C.

The trigger 1140 may have a trigger rail or gap 1171 formed therein. A split trigger configuration like this may allow for more flexibility, especially in asymmetric loading. The trigger 1140 may have curvature present in the lower end 1140*a* proximate to where it comes into (near) contact with the frame 1142. It has been discovered that the curvature may provide an added amount of flexibility to the trigger 1140 in the event the deadman is dropped. The bending moment may prevent breaking the trigger 1140.

FIGS. 11B-11C further illustrate the frame 1142 may be akin to a guard-type structure configured for coupling with a rail/handle portion 1142*c*. For example, the frame 1142 may be coupled to the portion 1142*c* via one or more pins (or the like) 1175. In this way, the frame 1142 may flex and/or pivot at the pins 1175. This movement may allow the frame 1142 to flex and pivot on the pins 1175 on each end thereof. The ability of the frame 1142 and the portion 1142*c* to flex at the pins 1175 may allow the frame 1142 to flex or deflect without breaking.

Figure 13B:
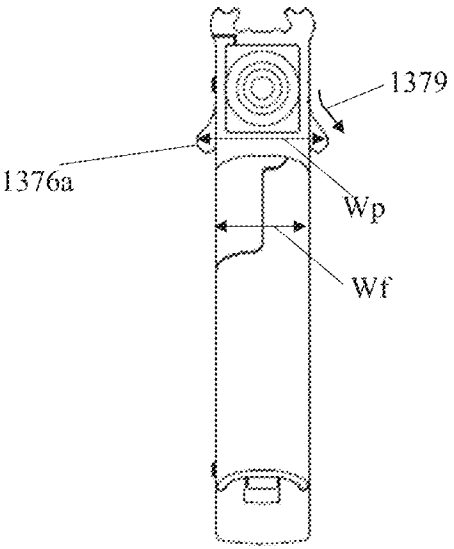
FIG. 13B shows a rear profile view of the deadman assembly according to embodiments of the disclosure.
Figure 13C:
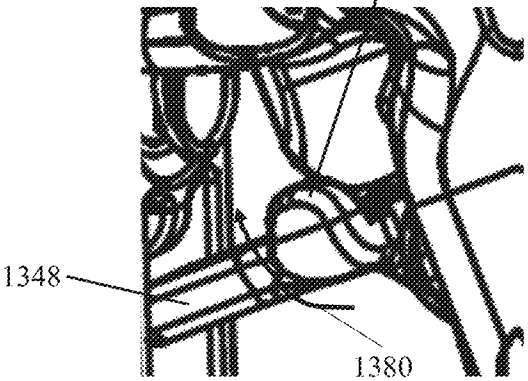
FIG. 13C shows a close-up view of a wing member for the deadman assembly of FIG. 13A according to embodiments of the disclosure.
Figure 13A:
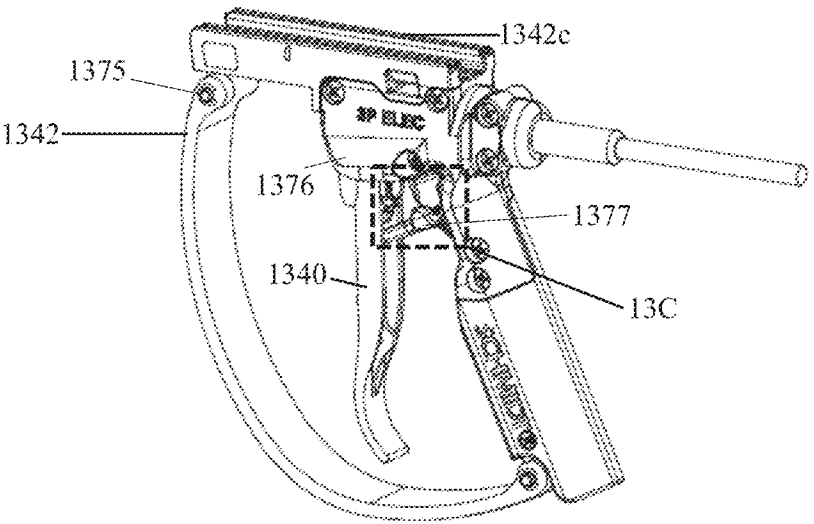
FIG. 13A shows a partial isometric view of a frame for a deadman assembly according to embodiments of the disclosure.

Referring briefly to FIGS. 13A, 13B, and 13C together, a partial isometric view of a frame for a deadman assembly, a rear profile view of the deadman assembly, and a close-up view of a wing member for the deadman assembly of FIG. 13A, illustrative of embodiments disclosed herein, are shown.

FIGS. 13A-13C together shows another embodiment of frame 1342 for use with a deadman assembly (e.g., 215, 915, etc.). The frame 1342 may have a trigger 1340 movably coupled therewith.

Of noticeable difference to the view shown in FIG. 11, FIG. 11A, etc. shows the trigger 1340 may have curvature. It has been discovered that some amount of curvature within the trigger 1340 may provide an added amount of flexibility therewith in the event the deadman is dropped.

The Figures further illustrate the frame 1342 may be akin to a guard-type structure configured for coupling with a rail/handle portion 1342*c*. For example, the frame 1342 may be coupled to the portion 1342*c* via one or more pins (or the like).

In this way, the frame 1342 may flex and/or pivot at the pins 1375. This movement may allow the frame 1342 to flex and pivot on the pins 1375 on each end thereof. The ability of the frame 1342 and the portion 1342*c* to flex at the pins 1375 may allow the frame 1342 to flex or deflect without breaking.

It has been further discovered that the use of a finger guard or sloped profile 1376 may aid in the prevention of inadvertent activation of the deadman (and/or trigger 1340). In an outlier event, it could be the case that a lock flap 1348 is kicked or moved from some other inadvertent force, thereby allowing the trigger member 1340 to move. The sloped profile 1376 results in an overhang that eliminates or mitigates this possibility. FIG. 13B in particular shows that from a lateral or rear perspective, the sloped profile 1376 is symmetrical or redundant to each side of the frame 1342. The sloped profile 1376 has a greater width or thickness Wp from this standpoint than that of a frame width Wf, and a downward slope 1376 that results in a profile end 1376*a* extending in a protective manner of where otherwise a finger or foot might inadvertently contact the lock flap 1348.

The frame 1342 of a deadman assembly may also have a winged member 1377. The winged member 1377 may be disposed or otherwise formed on the lock flap 1348. As shown here, the winged member 1377 may have an upward slope 1377 that results in a winged member end 1377 extending up toward profile end 1376*a*. The winged member 1377 (and its end 1377*a*) provide an operator with greater ease at moving the lock flap 1348 with a (gloved) finger as compared to just the lock flap 1348 itself, such that the winged member 1377 is akin to a 'grip' for a gloved fingertip. In embodiments, the winged member 1377 may be configured (such as with an end 1377*a*) in a manner so that it may be felt by an operator dressed in protective clothing, such as having a glove on.

Figures 12A, 12B:
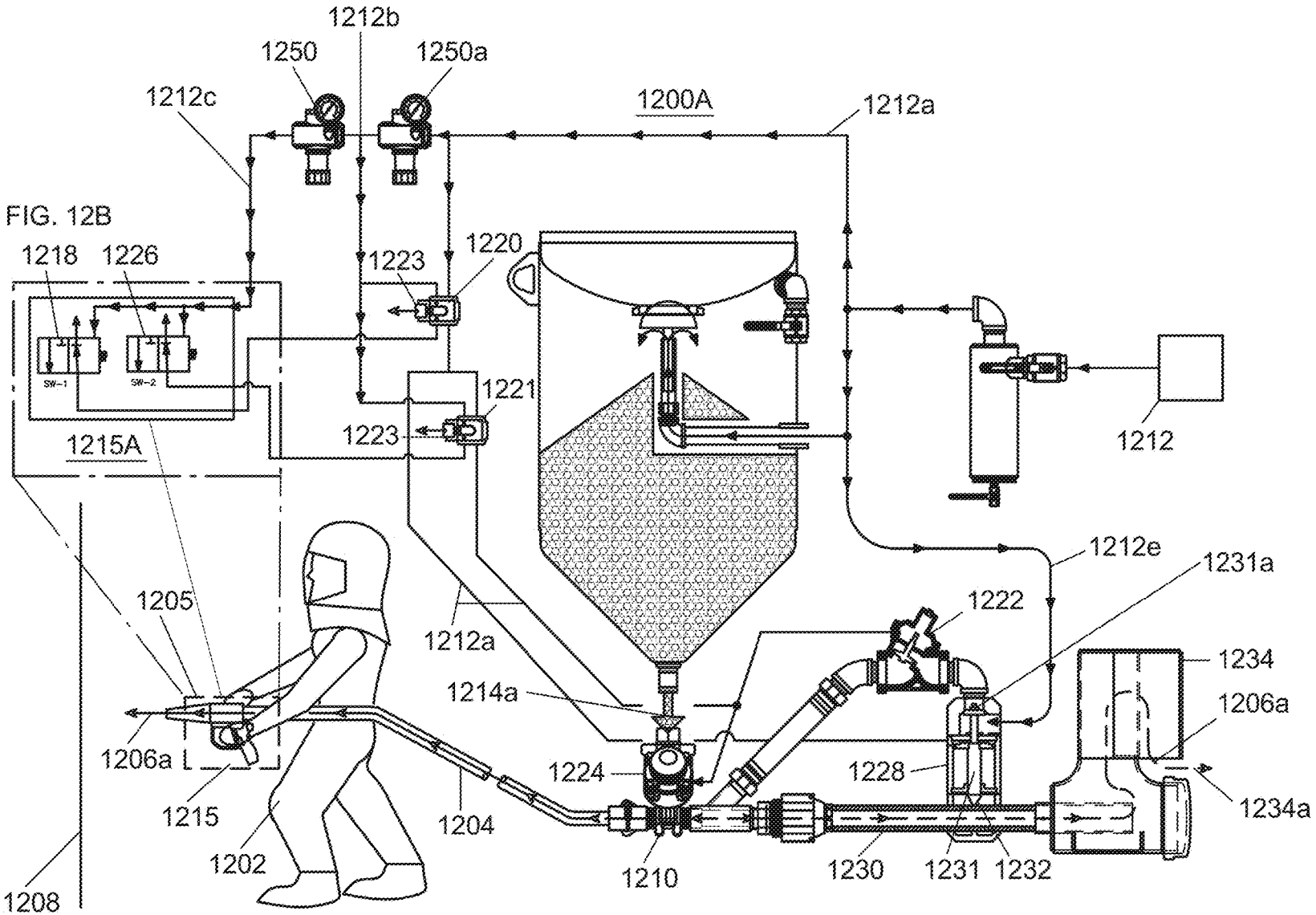
FIG. 12A shows a process diagram view of a pneumatic abrasive blasting system having an alternative valve configuration according to embodiments of the disclosure.
FIG. 12B shows a logic view of the valve assembly configuration for the system of FIG. 12A according to embodiments of the disclosure.

Referring now to FIGS. 12A, 12B, 12C, 12D, and 12E together, a process diagram view of a pneumatic abrasive blasting system having an alternative valve configuration, a logic view of the valve assembly configuration for the system of FIG. 12A, a cross-sectional body view of a control valve, a cross-sectional body view of the control valve in an activated position, and a cross-sectional body view of the control valve in a deactivated position, respectively, illustrative of embodiments disclosed herein, are shown.

FIG. 12A illustrates embodiments of an abrasive blasting operation that may utilize a multi-position, multi-configuration deadman assembly as described herein. While this Figure may depict use a pneumatic-type control configuration, other control mechanisms are possible, such as electrical.

While it need not be exactly the same, the system 1200A may be assembled, run, and operated as described herein and in other embodiments (such as for system 200, 500, 500A and so forth), and as otherwise understood to one of skill in the art.

Components of the system 1200A may be arranged by, disposed on, or otherwise coupled together, as otherwise understood to one of skill in the art. Thus, the system 1200A may be comparable or identical in some aspects, function, operation, components, etc. as that of other system embodiments disclosed herein (e.g., 200). Similarities may not be discussed for the sake of brevity, but are otherwise adopted herein.

Associated or auxiliary equipment including automation, controllers, piping, hosing, valves, wiring, nozzles, pumps, gearing, tanks, etc. may be shown only in part, or may not be shown or described, as one of skill in the art would have an understanding of coupling the components of the system 1200A for operation thereof. All components of the system 1200A requiring power or automation may be provided with wiring, tubing, piping, etc. in order to be operable therefore.

As discernable, embodiments herein provide for a pneumatic system that may utilize a first and second control valves (sometimes primary and secondary, respectively) 1220 and 1221, which may be of the same type of controller.

The first and second control valves 1220 and 1221 may be configured in a manner whereby a control signal may be withheld or otherwise disabled in a manner that the signal does not communicate past the valves. As such, when valves 1220, 1221 are closed, the valves may prevent an airflow signal 1212*a* from transferring airflow from source 1212 to respective downstream valves.

There may be a first deadman signal device 1218 and a secondary deadman signal device 1226, which may be in fluid communication with respective first and second control valves 1220, 1221, respectively. The deadman signal devices 1218, 1226 may be pneumatic trigger deadman cartridges. The deadman signal devices 1218, 1226 may be configured to send air from the reduced pressure air supply coming from regulator 1250 to the (pneumatic) control valves 1220 and 1221, respectively (which may be directly or indirectly). (Reduced) supply air 1212*b* may also be sent air from another regulator 1250*a* (directly or indirectly) to the (pneumatic) control valves 1220 and 1221, respectively. As shown, the first regulator 1250*a* and the second regulator 1250 may be in series communication. The first regulator 1250*a* may be analogous to an intermediate regulator, and thus disposed between the second regulator 1250 and the air source 1212. The reduced air 1212*b* may be constantly supplied to the valves 1220, 1221, with its pressure determined by the regulator 1250*a*.

The control valve 1220 may be configured to open on activation and send a full pressure air signal to a combo valve 1228. In an analogous manner, the second control valve 1221 may open on activation and send a full pressure air signal to the air valve 1222 pilot port and metering valve 1224 pilot port. Although described here as 'combo' valve, the valve 1228 may be a simple shut off valve, such as a ball valve or a pinch valve.

The deadman assembly 1215 may be configured such that the regulated supply air from the fitting on the outside thereof may travel through the deadman 1215 (body) to the deadman signal devices 1218 and 1226 supply sides, and when engaged by the deadman trigger, the control signals from the deadman signal devices 1218 and 1226 may then flow to the control valves 1220, 1221.

Air source 1212 may be in fluid communication with multiple flow paths. For example, source 1212 may provide control valve air source 1212*a*, as well as blast air source 1212*e*. Air source 1212*a* may communicate with control valve 1220. When the control valve 1220 is activated, the valve 1220 may signal the combo valve 1228 to open, thereby permitting air flow to blast air valve 1222. As shown here, when control valve 1220 is deactivated, the signal air to the combo valve 1228 and supply air to control valve 1221 may be vented 1223.

Figure 12D:
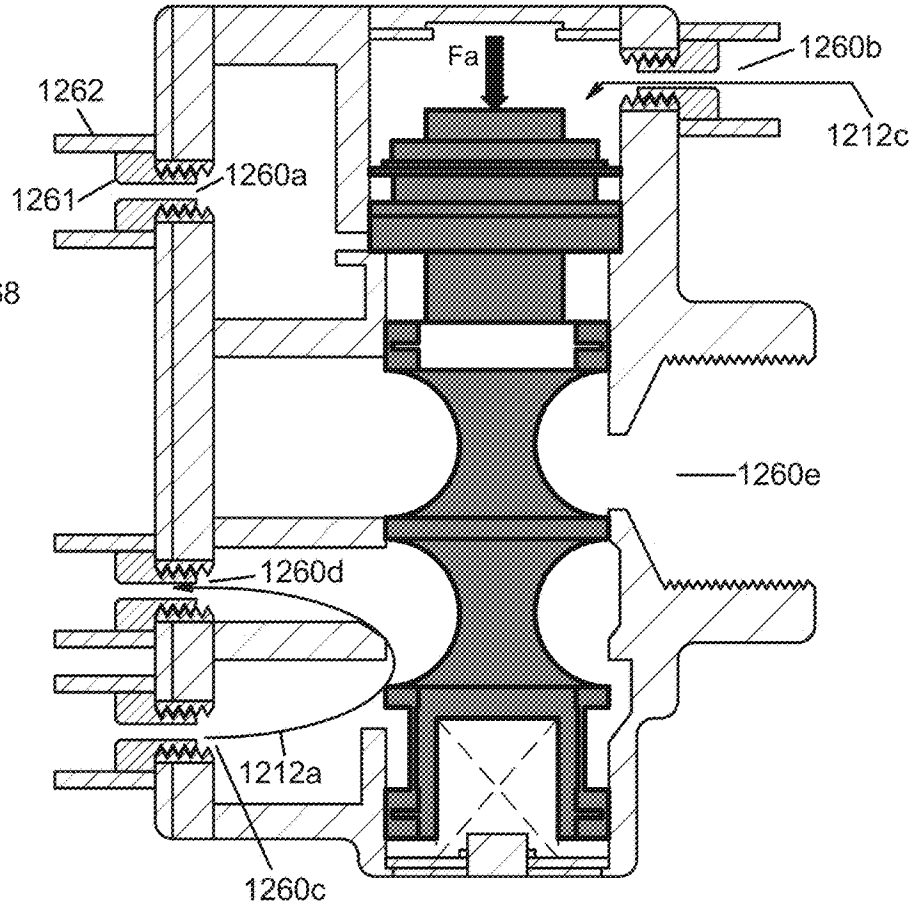
FIG. 12D shows a cross-sectional body view of the control valve of FIG. 12C in an activated position according to embodiments of the disclosure.
Figure 12C:
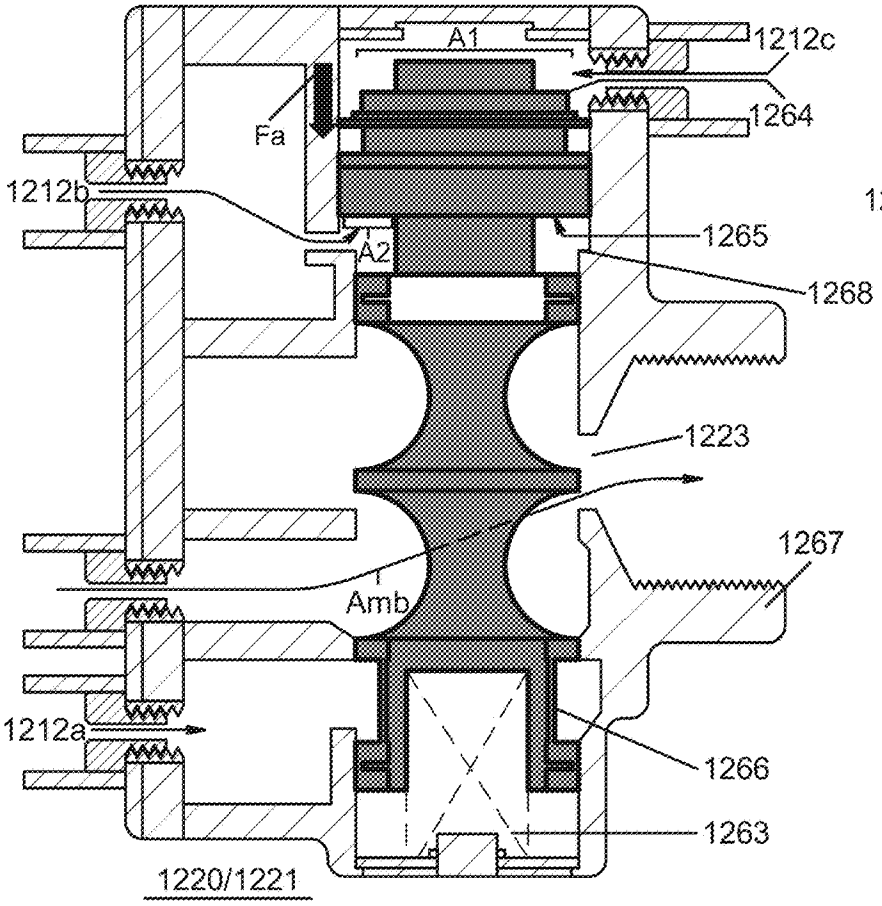
FIG. 12C shows a cross-sectional body view of a control valve according to embodiments of the disclosure.
Figure 12E:
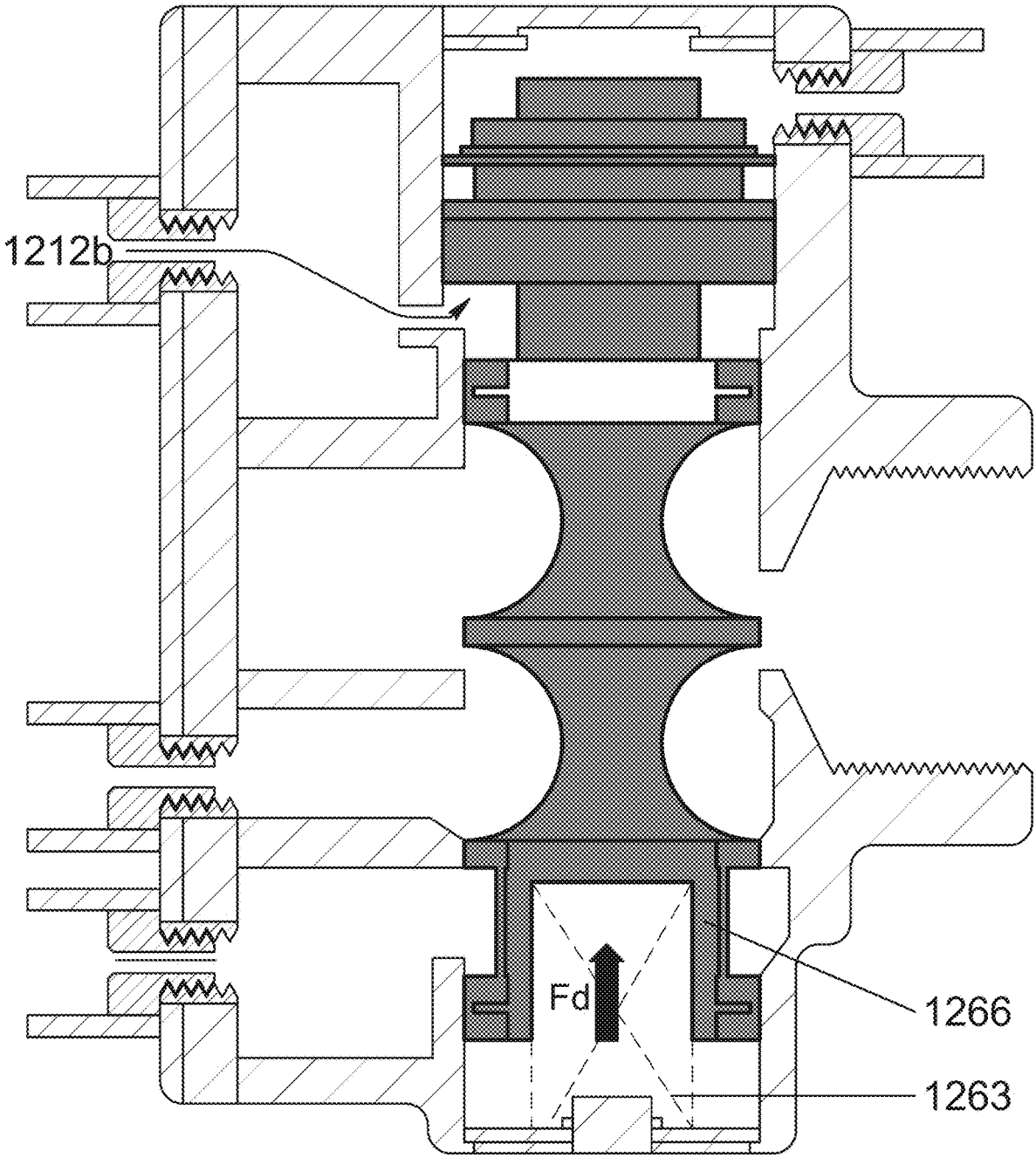
FIG. 12E shows a cross-sectional body view of the control valve of FIG. 12C in a deactivated position according to embodiments of the disclosure.

FIGS. 12C-12E illustrate either control valve 1220, 1221 having an activation and deactivation sequence. For example, FIG. 12C illustrates the valve 1220 (or 1221) having a valve body 1267 configured in a manner whereby an internal member (such a spool, etc.) 1266 may be moved from a deactivated position (e.g., FIG. 12C) to an activated position (e.g., FIG. 12D), and vice versa. The body 1267 may thus have one or more chambers, flow paths, etc.

As shown, the body 1267 may have one or more ports 1260*a-e*. The ports may be open to atmospheric or surrounding conditions, or may have one or more respective fittings 1261 couped therewith. Any fitting 1261 may have a respective hose, tubing, etc. 1262, which may, for example, facilitate the valve 1220, 1221 being in fluid communication with other components of the system 1200A.

FIG. 12C shows unregulated supply air 1212*a* communicated to supply port 1260*c*, whereby the supply air 1212*a* is prohibited from transferring therethrough. This may reflect the condition where the deadman assembly 1215 has not been, or was just, deactivated. In the same vein, first regulated air 1212*b* may enter support port 1260*a* and act on first working surface 1265. This pressure may facilitate keeping the valve 1220, 1221 in a deactivated position. In embodiments, the inner member 1266 may be biased (such as via bias member 1263) to the deactivated position. The bias member 1263 may be a spring or other suitable device.

However, as one or both of the deadman signal devices 1218, 1226 are activated by squeezing the deadman assembly trigger, second (re)regulated air 1212*c* may now be passed to the valve(s) 1220, 1221, such as shown entering feed port 1260*b*. Once airflow enters port 1260*b*, it may act upon second working surface 1264.

Of significance, although the pressure of second reduced or regulated air 1212*c* may be less than the pressure of first regulated air 1212*b*, the working surfaces 1264, 1265 may be configured in a manner whereby an overall balance of forces results in a larger net force Fa acting downward (relatively speaking) on the inner member 1266. As such, the first working surface 1265 may have a net surface area smaller than that of the second working surface 1264.

FIG. 12D shows the net force Fa moving the first working surface 1265 into contact with a shoulder or stop 1268. At this point, the valve 1220, 1221 is activated and open, and supply air 1212*a* may flow through the valve body 1267 and out exit port 1260*d* in order to be utilized with downstream system valves (e.g., 1228). Air is also prevented from venting out vent port 1260*e*.

This configuration allows for the minimization of the valve deactivation time by regulating 1212*b* and 1212*c* to maximize deadman venting speed by optimizing the valve deactivation/deadman pressure differential and deadman pressure. The lower the pressure differential the less pressure to be exhausted before deactivation. At the same time, the deadman valve(s) vents faster at higher pressures with the same differential pressure. There is a "sweet spot" where the differential and deadman pressures create the fastest deactivation time. FIG. 12E shows a simplified view of one or both of the deadman signal device 1218, 1226 being released, and thus deadman supply air 1212*c* no longer acts on the inner member 1266. As such, internal bias and regulated air 1212*b* assist in quickly venting 1212*c* through the deadman valves until the 1212*c* pressure sufficiently reaches the deactivation setting, and the valve 1220, 1221 closes.

When the deadman 1215 is released (e.g., FIG. 5C), the deadman supply port is shut off and the deadman signal or pilot port is vented to atmospheric through the deadman signal devices 1218, 1226 until the pressure drops below the control valve deactivation pressure at the pilot port. The control valve(s) 1220, 1221 may then shut off air pressure and vent the signal line of the abrasive, air, and exhaust valve to atmospheric through vents 1223.

With the air pressure regulators 1250, 1250*a* upstream of the deadman 1215 supply line, embodiments herein provide for the ability to optimize the deadman pressure and deadman/deactivation pressure differential to facilitate valve deactivation OFF response time to about two seconds or less.

In embodiments the pressure differential between the deadman assembly 1215 and either of the control valves 1220, 1221 may be in the range of about 1 psi above respective activation pressure to about 95 psi above deactivation pressure. In other embodiments, the pressure differential may be in the range of about 1 psi to about 40 psi. In still other embodiments, the pressure differential between the deadman assembly 1215 and the respective deactivation pressure setting may be in the range of about 10 psi to about 15 psi.

In embodiments, the elapse of time between deadman release and control valve deactivation may be less than 2 seconds. In other embodiments, the elapse of time is in a range of about 0.1 seconds to no more than 2 seconds.

In this respect, the primary controller 1220 may prevent airflow 1212*a* from transferring to combination valve 1228. As shown here, a ram 1231 may be in a normally open position when airflow 1212*a* is withheld from the valve 1228. At the same time, valve end 1231*a* may be closed, therefore preventing blast air 1212*e* to flow to the air valve 1222.

The deadman signal devices 1218, 1226 may be coupled with the logic flow and respective controllers via wiring, lines, infrared, or other suitable signal transmission configuration. Wiring (for air feed) may be disposed within a cavity of the deadman assembly 1215. The air feed may be coupled with the deadman supply line via couplers, fittings, nipples, etc.

Figure 14:
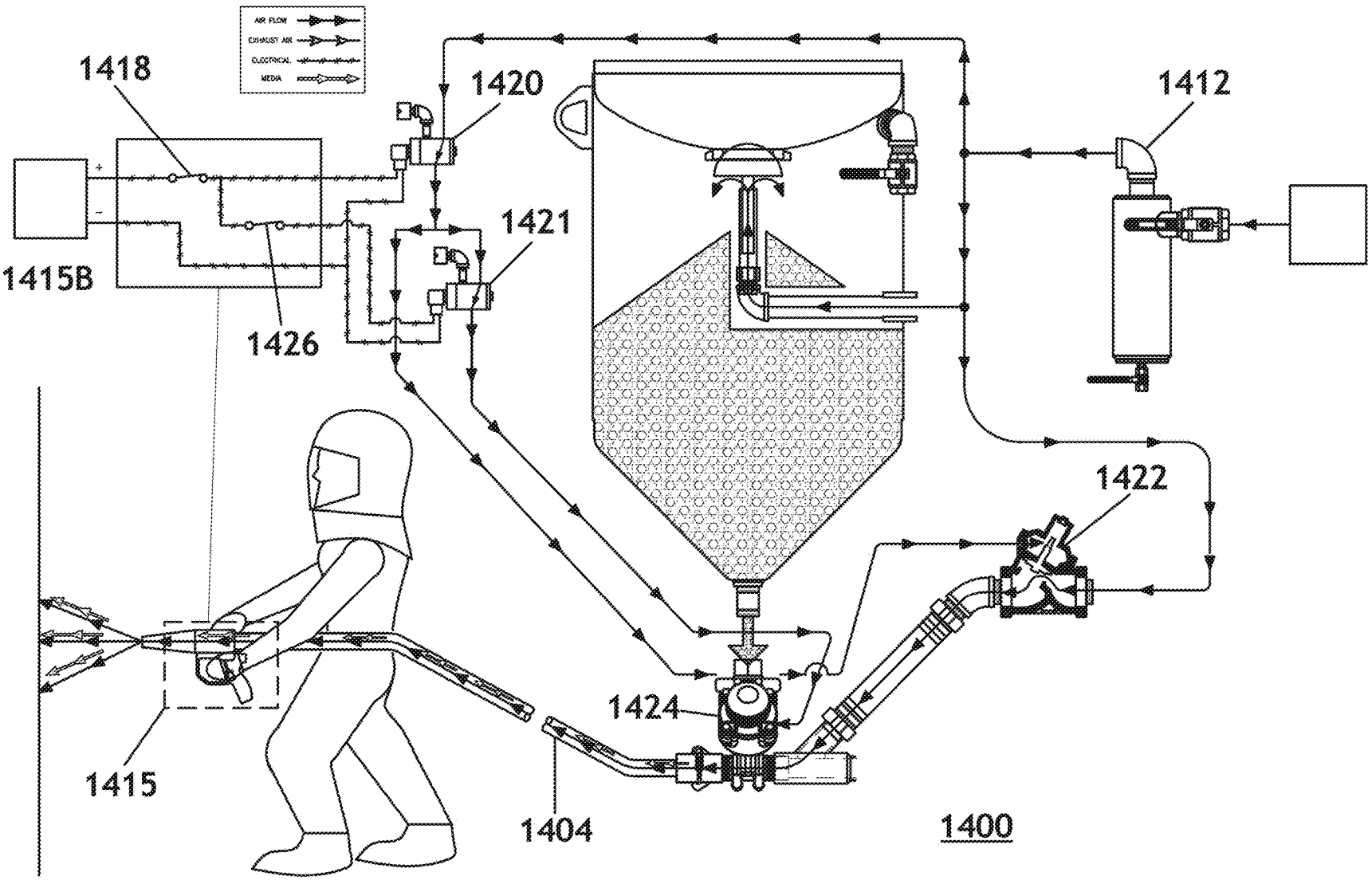
FIG. 14 shows a process diagram view of an abrasive blasting system having an alternative valve configuration according to embodiments of the disclosure.

Referring now to FIG. 14, a process diagram view of an abrasive blasting system having blast control configuration, respectively, illustrative of embodiments disclosed herein, are shown. FIG. 14 shows embodiments of an abrasive blasting operation that may utilize a multi-position, multi-configuration deadman assembly as described herein.

While it need not be exactly the same, the system 1400 may be assembled, run, and operated as described herein and in other embodiments (such as for system 200, 500, 500A, 1200 and so forth), and as otherwise understood to one of skill in the art. The blasting system 1400 may be useful for pneumatic, electrical, or as otherwise desired.

Components of the system 1400 may be arranged by, disposed on, or otherwise coupled together, as otherwise understood to one of skill in the art. Thus, the system 1400 may be comparable or identical in some aspects, function, operation, components, etc. as that of other system embodiments disclosed herein (e.g., 200). Similarities may not be discussed for the sake of brevity, but are otherwise adopted herein.

Associated or auxiliary equipment including automation, controllers, piping, hosing, valves, wiring, nozzles, pumps, gearing, tanks, etc. may be shown only in part, or may not be shown or described, as one of skill in the art would have an understanding of coupling the components of the system 1400 for operation thereof. All components of the system 1400 requiring power or automation may be provided with wiring, tubing, piping, etc. in order to be operable therefore.

The system 1400 may utilize a first and second control valve 1420 and 1421, which may be configured in a manner whereby a control signal may be withheld or otherwise disabled in a manner that the signal does not communicate past the valves. As such, when valves 1420, 1421 are not engaged, the valves may prevent a signal from transferring airflow from source 1412 to respective downstream valves (e.g., 1422, 1424).

The system 1400 may have a blast hose 1404 coupled with a deadman assembly 1415 (optionally for an electric configuration, may be operable with logic 1415B). The deadman assembly 1415 may be configured to facilitate transfer of control signals from the deadman assembly 1415 to the control valves 1420, 1421.

Air source 1412 may be in fluid communication with multiple flow paths. For example, source 1412 may provide control valve air, as well as blast air source air. As shown here the deadman assembly 1415 may utilize a first or primary deadman signal device 1418 in operable communication with the first control valve 1420 to control operation (open, close, etc.) of an air valve 1422. Control of the valve 1422 may correspond to the deadman 1415 (or respective trigger member) being moved to a desired position (not viewable here).

Analogously the deadman assembly 1415 may utilize a second or secondary deadman signal device 1426 in operable communication with the second control valve 1421 to control operation (open, close, etc.) of an abrasive flow valve 1424. Control of the valve 1424 may correspond to the deadman 1415 (or respective trigger member) being moved to another desired position (not viewable here).

In embodiments, there may be a deadman/hose configuration that may include one hose used for the supply air and one for the signal. In this way, the deadman assembly 1215 may be a 3-position, 2-function pneumatic deadman configured in operable communication with a multi-hose configuration, such as a "tripleline"—a hose configured to accommodate two signals sent to an abrasive blast unit, one for each control valve, plus the supply hose.

Embodiments herein may provide for methods of use and operation of one or more systems disclosed herein or comparable variants. Methods herein may refer to use and/or operation of an abrasive blasting operation that may utilize a multi-position, multi-configuration deadman assembly. While referred to as pneumatic, other control mechanisms are possible, such as electrical.

The method may include providing or arranging for one or more abrasive blasting components, such as a hose, blast pot, control valves, a deadman assembly, and so forth. The method may include use and/or operation of associated or auxiliary equipment including automation, controllers, piping, hosing, valves, wiring, nozzles, pumps, gearing, tanks, etc. may be shown only in part, or may not be shown or described, as one of skill in the art would have an understanding of coupling the components for operation thereof. All components of the method requiring power or automation may be provided with wiring, tubing, piping, etc. in order to be operable therefore.

The method may include use and/or operation of a deadman assembly that may be associated with a pneumatic flow control or comparable. The method may include operating the deadman assembly in a blast mode or a no-blast mode. There may be a no-blast, nozzle vent mode.

The method may include configuring the deadman assembly with one or more deadman signal devices operable to send or transfer air from the reduced pressure air supply coming from regulator to respective pneumatic control valves.

The method may include coupling respective hosing to fittings associated with the deadman assembly, air source, regulator, control valves, and any other downstream equipment. The air pressure regulator may be set to reduce the air pressure to the deadman assembly.

The method may include operating or moving a trigger of a deadman assembly to the blast mode (see FIGS. 7A-7C). As such, the deadman assembly signal devices may allow the compressed air to now flow into the signal port and then to the pilot port of the respective control valves. This pressure may be determined by the regulator. For example, the pressure in the line between the deadman and the control valves may be a reduced, regulated pressure of about 45 to 70 psig (as compared to the air source, which may be in excess of 120 psig).

The method may include releasing the deadman assembly to shut off, whereby the deadman supply port is shut off and the deadman signal or pilot port may be vented to atmospheric through the deadman signal devices until the pressure drops below the control valve deactivation pressure at the pilot port. The control valve(s) may then shut off air pressure and vent the signal line of the abrasive, air, and exhaust valve to atmospheric through vents.

The method may include a deactivation response time of about one to two seconds or less by reducing this pressure differential.

In some embodiments, it may be desirous to exceed minimum activation pressure to create a functional buffer to assure ample pressure to activate the control valves because the activation pressure could increase with wear and accumulation of contamination from normal use.

Higher pressure, at the same reduced pressure differential between deadman supply line and control valve, will result in faster control valve deactivation time.

In embodiments, there may be a deadman/hose configuration that may include one hose used for the supply air and two for the signal. In this way, the deadman assembly may be a 3-position, 2-function pneumatic deadman configured in operable communication with a multi-hose configuration, such as a "tripleline"—a hose configured to accommodate two signals sent to an abrasive blast unit, one for each control valve, plus the supply hose.

In aspects, there may be an airline configured in a manner to connect to fittings within the deadman configured to communicate with the deadman signal devices. An opposite, respective end(s) of the airline may be configured to couple with the regulator and valves.

The method may include moving a lock flap movingly coupled with a frame of the deadman assembly. The lock flap may be moved from a first lock flap position to another lock flap position, such as a second or third lock flap position.

The method may include moving the trigger and the lock flap in a suitable manner whereby the trigger may engage one or both of the deadman signal devices.

The method may include use of all embodiments herein expressed or implied.

ADVANTAGES

Embodiments of the disclosure may provide for a fast, responsive shutoff system to address the undesirable side effects without compromising the safety created by the quick response. In particular embodiments herein may mitigate or reduce noise pollution by providing an operator an ability to control the shutoff method, using the non-emergency shutoff method of venting through the nozzle unless the emergency method is needed. Exhaust noise may be mitigated or eliminated outright for controlled shutoff. This may synergistically reduce the amount of expended abrasive that would otherwise accumulate around the blast pot from repeated deadman release.

Embodiments of the disclosure may reduce wear on the exhaust line at the pinch point of the valve, thereby extending the time the pinch ram will pinch and seal the line, thus reducing maintenance and associated time and income lost due to down time.

While preferred embodiments of the disclosure have been shown and described, modifications thereof may be made by one skilled in the art without departing from the spirit and teachings of the disclosure. The embodiments described herein are exemplary only and are not intended to be limiting. Many variations and modifications of the embodiments disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. An abrasive blasting system comprising:
a blast hose;
a deadman assembly coupled with the blast hose, the deadman assembly further comprising:
a primary deadman signal device;
a base frame, with the primary deadman signal device housed at least partially within the base frame;
a trigger member movably coupled with the base frame, the trigger member configured to contact and move the primary deadman signal device to a signal-flow position, the trigger member further comprising:
a first plunger cavity; and
a first plunger movably disposed in the first plunger cavity;
an air source configured for fluid communication with the blast hose,
wherein a first bias member disposed around the first plunger, facilitates a range of motion of the trigger member while a first plunger end of the first plunger is engaged with the primary deadman signal device, and the primary deadman signal device is in a signal flow position.

2. The abrasive blasting system of claim 1, wherein the deadman assembly comprises a second biased member configured to facilitate a second movable plunger engaging a secondary deadman signal device.

3. The abrasive blasting system of claim 1, wherein the first plunger comprises a plunger lip, wherein the first plunger cavity comprises a cavity lip, wherein the primary signal device is not disposed at least partially within the cavity, and wherein the first bias member is maintained between the plunger lip and the cavity lip.

4. The abrasive blasting system of claim 3, wherein the first plunger further comprises a second plunger end, a plunger hollow, and a plunger cap engaged with the second plunger end, and wherein the plunger cap is engaged with the plunger lip when the trigger member is in a no-blast position.

5. A method of abrasive blasting, the method comprising:
providing a blast hose, the blast hose operatively used with a deadman assembly;
feeding an abrasive media to the blast hose;
operating the deadman assembly in a manner to result in discharge of the abrasive media from a spray nozzle end of the blast hose,
wherein the deadman assembly comprises:
a primary deadman signal device;
a base frame, with the primary deadman signal device housed at least partially within the base frame; and
a trigger member movably coupled with the base frame, the trigger member configured to contact and move the primary deadman signal device to a signal-flow position, the trigger member further comprising:
a first plunger cavity formed within the trigger member and having a first cavity lip;
a first plunger movably disposed in the first plunger cavity;
a first bias member movably disposed around the first plunger, and engaged with the first cavity lip,
wherein the first bias member facilitates a range of motion of the trigger member while a first plunger is engaged with the primary deadman signal device, and the primary deadman signal device is in a signal flow position.

6. The method of abrasive blasting of claim 5, wherein the first plunger comprises a plunger lip, wherein the first plunger cavity comprises a cavity lip, and wherein the first bias member is maintained between the plunger lip and the cavity lip.

7. The method of abrasive blasting of claim 6, wherein the first plunger further comprises a second plunger end, and a plunger hollow closed at the first plunger end and engaged with a plunger cap at the second plunger end.

8. A deadman assembly comprising:
a primary deadman signal device;
a base frame, with the primary deadman signal device housed at least partially within the base frame; and
a trigger member movably coupled with the base frame, the trigger member further comprising:
a first plunger cavity;
a first plunger movably disposed within the first plunger cavity, the first plunger configured to contact and move the primary deadman signal device to a signal-flow position; and
a first biased member disposed around the first plunger, the first biased member configured to facilitate the first movable plunger engaging the primary deadman signal device;
wherein the first biased member facilitates a range of motion of the trigger member while the first plunger is engaged with the primary deadman signal device.

9. The deadman assembly of claim 8, wherein the deadman assembly further comprises a lock flap movably engaged between the base frame and the trigger member, the lock flap comprising a first lock flap position and an other lock flap position, wherein the primary deadman signal device is configured to transmit a control signal, wherein when the lock flap is in the first lock flap position the trigger member is prohibited from engaging the primary deadman signal device.

10. The deadman assembly of claim 9, wherein when the lock flap is in the other lock flap position, the trigger member is not prohibited from engaging the primary deadman signal device.

11. The deadman assembly of claim 8, wherein the first plunger comprises: a first plunger end configured for direct physical contact with the primary signal device, a plunger lip; a second plunger end; and a plunger hollow closed at the first plunger end, and engaged with a plunger cap at the second plunger end, wherein the first plunger is external of the base frame, wherein the first plunger cavity comprises a hollow narrowed by a cavity lip, and wherein the first biased member is maintained between and in engagement with both the plunger lip and the cavity lip.

12. The deadman assembly of claim 11, wherein the deadman assembly comprises a sloped guard profile having a guard profile end, and a winged member having a winged member end proximate the guard profile end, wherein the guard profile end has a lateral profile radial greater than a lateral member radial of the winged member end.

13. The deadman assembly of claim 8, wherein the deadman assembly comprises a second biased member configured to facilitate a second movable plunger engaging a secondary deadman signal device.

14. A deadman assembly comprising:

a primary deadman signal device;

a base frame, with the primary deadman signal device housed at least partially within the base frame; and a trigger member movably coupled with the base frame, the trigger member further comprising:

a first plunger cavity;

a first plunger movably disposed within the first plunger cavity, the first plunger having a first plunger end configured to contact and move the primary deadman signal device to a signal-flow position; and a first biased member disposed around the first plunger, and configured to facilitate the first movable plunger engaging the primary deadman signal device, wherein the first biased member facilitates a range of motion of the trigger member while the first plunger is engaged with the primary deadman signal device.

15. The deadman assembly of claim 14, wherein the primary signal device and does not reside at least partially within the first plunger cavity.

16. The deadman assembly of claim 15, wherein the primary deadman signal device is configured to transmit a control signal.

17. The deadman assembly of claim 16, wherein the first plunger further comprises a plunger lip, wherein the first plunger cavity comprises a cavity lip, and wherein the first biased member is maintained between and in engagement with both the plunger lip and the cavity lip.

18. The deadman assembly of claim 17, wherein the deadman assembly comprises a sloped guard profile having a guard profile end, and a winged member having a winged member end proximate the guard profile end, wherein the guard profile end has a lateral profile radial greater than a lateral member radial of the winged member end.

19. The deadman assembly of claim 14, wherein the deadman assembly comprises a sloped guard profile having a guard profile end, and a winged member having a winged member end proximate the guard profile end, wherein the guard profile end has a lateral profile radial greater than a lateral member radial of the winged member end.

20. The deadman assembly of claim 14, wherein the first plunger comprises a plunger lip, wherein the first plunger cavity comprises a cavity lip, and wherein the first biased member is maintained between and in physical contact with both the plunger lip and the cavity lip.

21. The deadman assembly of claim 20, wherein the first plunger further comprises a second plunger end, and a plunger hollow closed at the first plunger end and engaged with a plunger cap at the second plunger end.

* * * * *